US009951425B2

(12) United States Patent
Lancaster-Larocque et al.

(10) Patent No.: US 9,951,425 B2
(45) Date of Patent: Apr. 24, 2018

(54) SOLID STATE DEPOSITION METHODS, APPARATUSES, AND PRODUCTS

(71) Applicant: Apple Inc., Cupertino, CA (US)

(72) Inventors: Simon R. Lancaster-Larocque, Gloucester (CA); Collin D. Chan, Dublin, CA (US); Kenneth A. Ross, Granger, IN (US); Lindsay D. Corbet, San Jose, CA (US); Ari P. Miller, San Francisco, CA (US); Thomas G. Budd, Granger, IN (US)

(73) Assignee: Apple Inc., Cupertino, CA (US)

( * ) Notice: Subject to any disclaimer, the term of this patent is extended or adjusted under 35 U.S.C. 154(b) by 661 days.

(21) Appl. No.: 14/340,473

(22) Filed: Jul. 24, 2014

(65) Prior Publication Data

US 2015/0030379 A1 Jan. 29, 2015

Related U.S. Application Data

(60) Provisional application No. 61/858,572, filed on Jul. 25, 2013.

(51) Int. Cl.
*C23C 24/04* (2006.01)

(52) U.S. Cl.
CPC ..... *C23C 24/04* (2013.01); *Y10T 29/4998* (2015.01); *Y10T 403/472* (2015.01)

(58) Field of Classification Search
CPC .... C23C 24/04; B23K 20/122; B23K 20/128; B23K 20/1225; Y10T 403/472
See application file for complete search history.

(56) References Cited

U.S. PATENT DOCUMENTS 3,000,576 A 9/1961 Levey et al.
6,045,027 A * 4/2000 Rosen ..... B23K 20/122 228/112.1

(Continued)

FOREIGN PATENT DOCUMENTS

JP 2011025275 A 2/2011
TW I335251 B 1/2011

(Continued)

OTHER PUBLICATIONS

PCT/US2014/037985—International Search Report & Written Opinion dated Sep. 24, 2014.

(Continued)

*Primary Examiner* — Daniel J Wiley
(74) *Attorney, Agent, or Firm* — Downey Brand LLP

(57) ABSTRACT

The described embodiments relate generally to methods for enhancing cosmetic surfaces of friction stir processed parts. More specifically a method for applying cold spray over a weld line generated by friction stir processing is disclosed. Methods are also disclosed for blending the cold spray applied over the weld line with a cosmetic surface portion of the friction stir processed parts. In some embodiments cold spray can be used to create a cosmetic joint between various parts. Structural joints between first and second substrates may also be formed via solid state deposition. Such joints may be strengthened through use of a hidden weld, mechanical interlocking between the substrates, and/or coupling via fasteners.

21 Claims, 25 Drawing Sheets

(56) References Cited

U.S. PATENT DOCUMENTS

| | | | | |
|---|---|---|---|---|
| 6,368,008 | B1 * | 4/2002 | Biernat | B62D 27/026 29/458 |
| 7,455,212 | B2 * | 11/2008 | Mika | B23K 20/1245 228/112.1 |
| 7,694,867 | B2 * | 4/2010 | Swallow | B23K 20/122 228/112.1 |
| 8,052,033 | B2 * | 11/2011 | Nakagawa | B23K 20/122 228/112.1 |
| 9,051,633 | B2 * | 6/2015 | Ozeki | B23K 20/122 |
| 2003/0111514 | A1 * | 6/2003 | Miyanagi | B23K 20/12 228/112.1 |
| 2007/0138235 | A1 | 6/2007 | Kumagai et al. | |
| 2008/0003355 | A1 | 1/2008 | Piton et al. | |
| 2008/0047222 | A1 * | 2/2008 | Barnes | B23K 20/1225 52/693 |
| 2010/0089976 | A1 | 4/2010 | Szymanski et al. | |
| 2013/0029114 | A1 | 1/2013 | Ozeki et al. | |
| 2013/0082033 | A1 * | 4/2013 | Volchko | B05D 1/02 219/117.1 |
| 2013/0292152 | A1 | 11/2013 | Kayamoto et al. | |
| 2014/0339093 | A1 | 11/2014 | Lancaster-Larocque et al. | |
| 2015/0030379 | A1 | 1/2015 | Lancaster-Larocque et al. | |

FOREIGN PATENT DOCUMENTS

| | | | |
|---|---|---|---|
| TW | I352640 | B | 11/2011 |
| WO | WO2012046352 | A1 | 4/2012 |
| WO | WO2012093614 | A1 | 7/2012 |

OTHER PUBLICATIONS

Taiwanese Patent Application No. 103117518—Office Action dated Feb. 24, 2016.

* cited by examiner

SOLID STATE DEPOSITION METHODS, APPARATUSES, AND PRODUCTS

CROSS-REFERENCE TO RELATED APPLICATION(S)

This application claims priority to U.S. Provisional Application No. 61/858,572 filed Jul. 25, 2013, entitled "SOLID STATE DEPOSITION METHODS, APPARATUSES, AND PRODUCTS" which is incorporated herein by reference in its entirety.

FIELD

The described embodiments relate generally to solid-state deposition. In particular, solid-state deposition methods, apparatus, and systems can be used to provide an appearance of visual continuity between regions of a metal substrate exhibiting different properties. The different properties can be different visual properties, different chemical properties, different mechanical properties, and so forth. In the case of different visual properties, for example, a region having a specific bulk micro-structure (such as grain size, orientation, etc.) can reflect light in a manner consistent with the specific bulk microstructure. For example, a first region associated with a first microstructure can interact with light in a manner sufficiently different than that of a second region having a second microstructure that results in a noticeably different visual appearance between the two regions. Therefore, it is important to eliminate any such differences in visual appearance in those situations that such visual differences adversely affect the overall aesthetic value of an object.

BACKGROUND

Several methods may be used to join two or more substrates. Some processes include a heating process which may either melt portions of the substrates or melt another material to a pair of substrates. While this may form sufficient mechanical bond, the appearance of the substrates may be altered. This may limit bonding processes to internal portion of a device not intended to be visible, thereby limiting the applications for the bonding processes.

Also, methods may are available to correct defects of armored vehicles, such as tanks. For example, a manual deposition of particles may be applied to a crack or broken portion of the tank. However, the application of particles leaves a substantially non-uniform or discontinuous area. In other words, the appearance of the manual deposition is different from that of areas immediately surrounding the manual deposition; differences include a difference in color, roughness, reflectivity, or a combination thereof. However, this contrast in appearance may be unappealing in other applications, such as consumer products.

SUMMARY

In one aspect, a substrate for enclosing an electronic device is described. The substrate may include a first substrate engaged with a second substrate in a joined portion. In some embodiments, the first substrate and the second substrate may have a first appearance. The substrate may further include an indention formed in the first portion and the second portion proximate to the joined portion. The substrate may further include a deposition layer having several metallic particles positioned in the indention. The substrate may further include a mechanical structure. In some embodiments, the first substrate and the second substrate are held together by the deposition layer and the mechanical structure.

In another aspect, a method for enhancing an appearance of a joint configured to maintain engagement of a first substrate and a second substrate is described. The method may include aligning a first substrate and second substrate to define a joined portion. The first substrate and the second substrate may combine to include an exterior portion and an interior portion. The method may further include depositing a solid state deposition layer at the joined portion. In some embodiments, the solid state deposition layer may be positioned on the exterior portion of the first substrate and the second substrate. The method may further include inserting a mechanical structure that engages the first substrate and the second substrate. In some embodiments, the mechanical structure is proximate to the interior portion. Also, in some embodiments, the first substrate and the second substrate are held together by the solid state deposition layer and the mechanical structure.

In another aspect, a method of enhancing the appearance of a first substrate and a second substrate joined together by a solid state deposition is described. The method may include engaging the first substrate with the second substrate. The method may further include applying a solid state deposition over the first substrate and the second substrate to define a joint. In some embodiments, the first substrate and the second substrate have a first appearance. Also, in some embodiments, the solid state deposition has a second appearance different from the first appearance.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
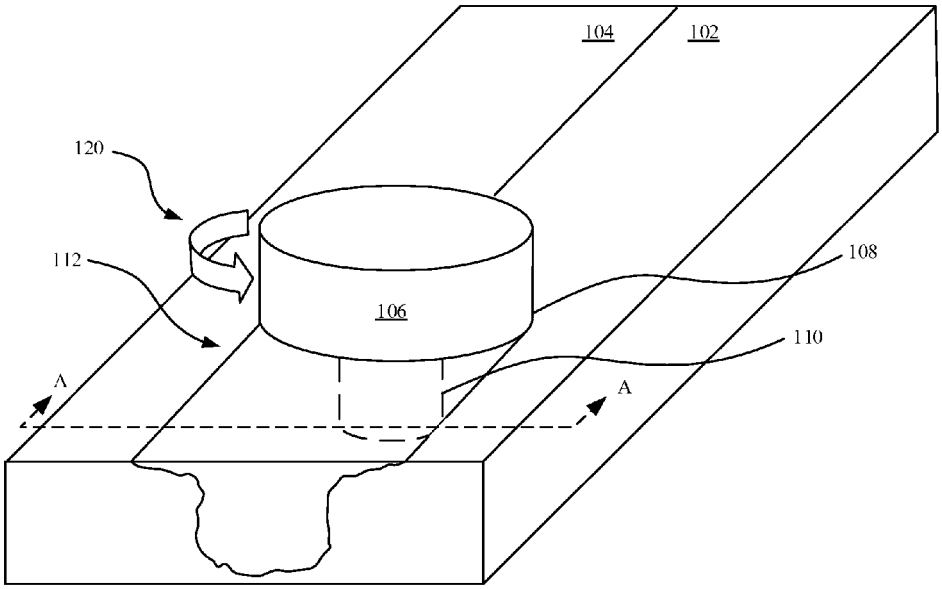
FIG. 1 illustrates a perspective view of a friction stir welding process joining metal substrates according to an example embodiment of the present disclosure.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

It should be noted that in the following discussion, FSW is used as a representative metallurgical operation. However, the described embodiments can relate to any metallurgical operation or process that can result in varying microstructure within a metal substrate. The varying microstructures (such as grain size) can result in different properties depending upon various factors. The different properties, in turn, can cause visible defects which are generally undesirable. In this way, solid-state deposition processes, such as cold spray, can be used to obscure other otherwise hide any visible defects. Moreover, in addition to obscuring cosmetic defects, cold spray can be used to join at least two metal parts. It should also be noted, since cold spray utilizes metal particles to form a metal layer on the metal substrate, the metal layer can undergo a number of finishing operations. The finishing operations can be used to provide a desired surface texture using sand blasting techniques or a polishing operation can be used to provide a more mirror like finish. For example, if the metal layer includes a thickness on the order of 100 microns (and depending upon machine and part tolerance), a portion of the metal layer can be removed using any number and type of machining processes. If, on the other hand, the metal layer includes a thickness substantially less than 100 microns, then a polishing or sanding operation may be more appropriate. It should also be noted that a first species of metal can be deposited on a second species of metal. In some cases, the first species and second species of metal can belong to the same family of metals (AL, for example) but different alloys. For example, the first species of metal can be aluminum whereas the second species of metal can also be aluminum. Therefore, the terms "first species" and "second species" can be broadly interpreted to mean metals that are compatible with the solid-state deposition process.

FIG. 1 shows a perspective view of an exemplary FSW operation. As illustrated, FSW may be used to join two substrates 102, 104, both of which may be made from metal. The composition of the metal substrates 102, 104 can collectively be referred to as a base material. Prior to the FSW operation, the mating surfaces of the metal substrates 102, 104 to be joined are clamped together at an interface by a clamping tool (not shown).

The FSW operation involves FSW tool 106. FSW tool 106 is a rotational tool that typically includes at least shoulder 108 and pin 110. By rotating FSW tool 106 rapidly, for example in the direction indicated by the tool rotation arrow 120, pin 110 can create friction which imparts heat sufficient to stir up the material on both sides of the interface between the metal substrates 102, 104. Also, while rotating FSW tool 106, FSW tool 106 may be actuated along the region in which substrates 102 and 104 are joined. In this way, a friction stir welded region 112 is formed that joins metal substrates 102 and 104 together.

FSW causes changes in the microstructure of the base material defining the metal substrates 102, 104. Extreme plastic deformation and significant heat generation in the friction stir process zone results in recrystallization and development of texture within the friction stir process zone. Precipitate dissolution and coarsening in and around the process zone may also occur.

Figure 2:
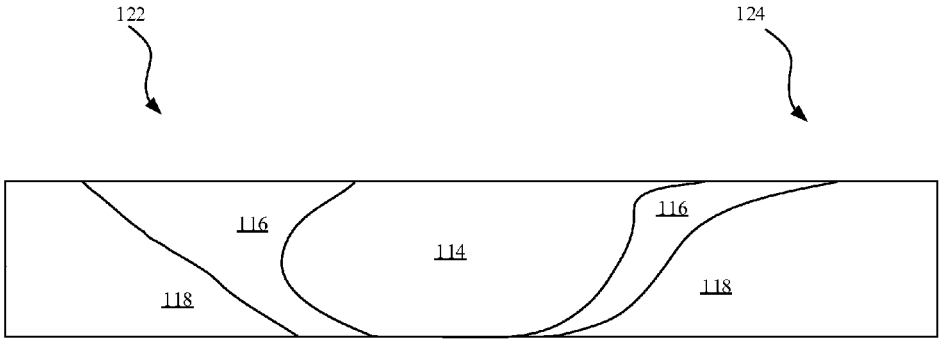
FIG. 2 illustrates a cross-sectional view along line A-A in FIG. 1 of microstructural zones of the metal substrates after friction stir welding is completed thereon according to an example embodiment of the present disclosure.

FIG. 2 is a cross-sectional view along line A-A from FIG. 1 illustrating the microstructural zones resulting from FSW. As shown, the microstructural characterization of grains and precipitates generated by FSW may be broken down into three distinct zones: a stirred zone (nugget zone) 114, a thermo-mechanically affected zone (TMAZ) 116, and a heat-affected zone (HAZ) 118, as described below. It should be noted that microstructure within each zone can also be highly variable.

A recrystallized fine-grained microstructure is formed by the intense frictional heating and plastic deformation that occurs during FSW. This fine-grained recrystallized region is known as the nugget zone 114 or the dynamically recrystallized zone (DXZ). Typically, there is low dislocation density in the interior of the recrystallized grains. As illustrated, the interface between nugget zone 114 and the remainder of the parent metal is relatively diffuse on the retreating side 122 and sharp on the advancing side 124.

The thermo-mechanically affected zone (TMAZ) 116 is a transition zone between the parent material and nugget zone 114 that is unique to FSW. Both temperature and plastic deformation are experienced by the TMAZ 116 during FSW, resulting in a highly deformed structure. The elongated grains of the parent metal are deformed in a flowing pattern around nugget zone 114. Dissolution of some precipitates is typically observed in TMAZ 116.

The heat affected zone (HAZ) 118 experiences a thermal cycle during FSW but does not experience plastic deformation. Although the HAZ 118 retains the same grain structure as the parent material, thermal exposure can have a significant effect on the precipitate structure. Coarsening of the strengthening precipitates and widening of the precipitate-free zone (PFZ) is a common concern in FSW of precipitate strengthened alloys.

Certain finishing operations may be performed on a joined part after the completion of the welding operation. For example, anodizing is an electrolytic passivation process that increases the natural oxide layer on the surface of the metal part. Etching is often a part of the anodizing process. Etching is a process where a chemical or electrochemical attack is used to remove material from unprotected metal. In metallography it is a common practice to use chemical etchants to reveal the microstructure of metallurgical samples. The electrochemical potential of the metal is a function of microstructure. Therefore the metal will corrode at rates that vary with microstructure. Varying corrosion rates lead to variations in topology and/or reflectivity. Variation in the initial microstructure, especially the precipitate distribution, of a part has a strong effect on the final surface appearance of an anodized part. Accordingly, a joined part may exhibit variations in appearance at the weld created by FSW after finishing, which may be cosmetically displeasing.

Thus, embodiments of the present disclosure relates to methods for cosmetically enhancing the appearance of a part joined by FSW or other processes, which would otherwise include variations in appearance. One solution is to remove the etching step from the anodizing process to eliminate the formation of etching pits. In this regard, iron rich intermetallic particles act as cathodic reaction sites during etching of aluminum and cause large etching pits which decrease surface gloss. $Mg_2Si$ precipitate particles act as anodes during etching and dissolve forming small etching pits that decrease surface gloss. Eliminating the etching step will enhance the post anodized uniformity of surface gloss. However, etching may be useful to provide the anodized part with a desirable matte appearance.

Another solution is to use solid state deposition processes to cosmetically enhance the appearance of a joint, as discussed hereinafter. Various other applications of solid state deposition processes are also discussed hereinafter. Solid state deposition processes function by propelling particles at high velocity to impact a substrate. When the particles impact the substrate, the particles undergo plastic deformation, forming a metallurgical bond to the surface. Solid state deposition may include a cold spray process. Various other embodiments of solid state deposition, which may also be referred to as thermal spraying include, for example, plasma spraying, detonation spraying, wire arc spraying, flame spraying, high velocity oxy-fuel coating spraying (HVOF), and warm spraying.

Because solid state deposition is a solid state process, it shares many of the same advantages as friction stir welding such as reduced heat input, oxidation, and grain growth. Further advantages of solid state deposition, and in particular cold spray are as follows: high deposition rate, little or no masking required, no grit blast required, high density, flexibility in substrate coating, minimum thermal input to substrate, high bond strength, compressive residual stresses, ultra-thick coatings are possible, no oxidation, no grain growth, high conductivity, high corrosion resistance, and high strength and hardness.

Figure 3:
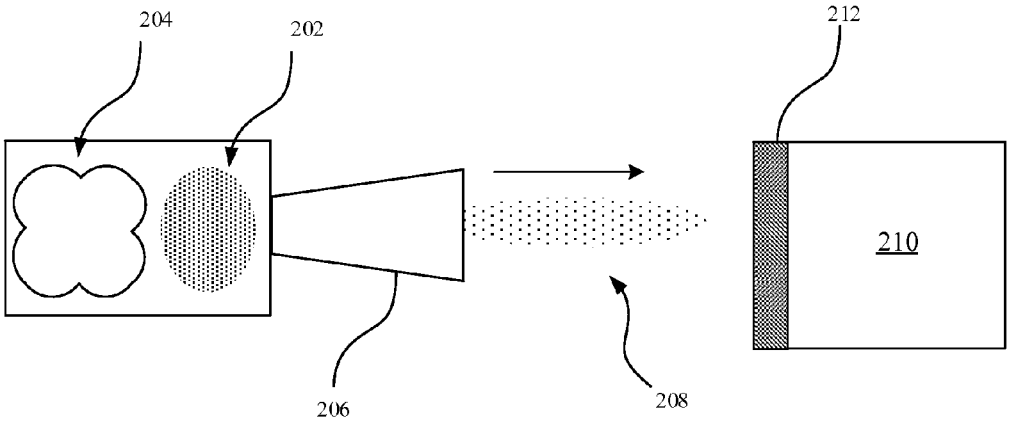
FIG. 3 illustrates a simplified representation of a cold spray process according to an example embodiment of the present disclosure.

A simplified diagram of the cold spray process is shown in FIG. 3. As illustrated, the cold spray process may include directing powder particles 202 and a carrier gas 204 through a nozzle 206. In some embodiments, carrier gas 204 is heated. The resulting high-velocity particle-gas mixture 208 may thus be directed at substrate 210. As the high-velocity particle-gas mixture 208 impacts substrate 210, a layer of deposited material 212 may form thereon as the particles plastically deform and bond to substrate 210. As additional particle-gas mixture 208 are directed to substrate 210, the thickness of the resulting layer of deposited material 212 continues to build to the extent desired.

One advantage of solid state deposition processes such as cold spray is that the material from which the powder particles are formed may be selected to define a desirable characteristic. For example, the material defining the powder particles may be selected to match the material defining the substrate. In some embodiments, the substrate defines a computer housing formed from aluminum (e.g., A1-6063-T6), and the powdered particles are formed from the same aluminum (e.g., AA6063 −325 mesh/+10 microns or AA6063 −325 mesh/+5 microns). However, as discussed below, differing materials may be selected in other embodiments.

The basic requirement for the powder particles 202 is that they must be able to flow through the nozzle. Cold spray is done almost exclusively with atomized powder. The atomization process generates spherical particulates which flow well through the nozzle. For cold spray, the powder particles need to be in the range of 5-50 μm (micrometers) diameter to be effective. Uniformity of the size of the powder particles is advantageous in that deposition rates increase with less variation in size.

With respect to the gas 204, typically helium and nitrogen are employed for cold spraying. Both gases are considered inert during cold spray. Helium is required to cold spray some high melting temperature alloys. This is because velocities achieved with nitrogen are insufficient to provide the kinetic energy required for the particle to bond with the substrate on impact. In this regard, the sonic velocity of helium is three times that of nitrogen. Further, attempting to soften some high melting temperature alloy powders to enable cold spray using nitrogen may not be feasible because it would require the nitrogen to be heated to a temperature at which the gas is no longer inert. However, helium gas may be considerably more expensive than nitrogen unless helium recycling systems are used. Accordingly, helium gas may be used only when high sonic velocities or pre-heat temperatures are required for the particular cold spray application.

Figure 4:
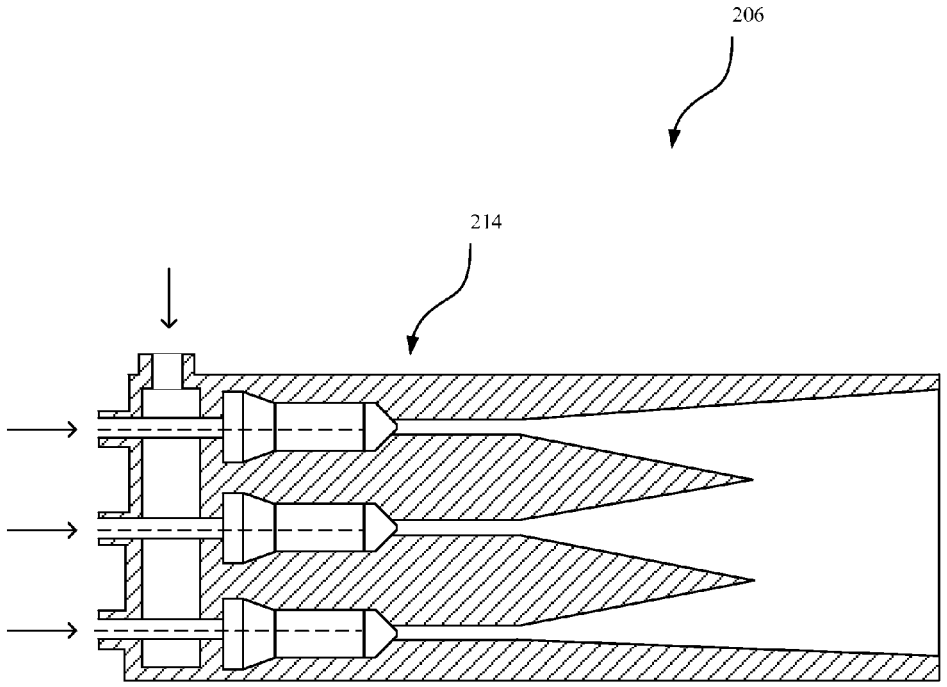
FIG. 4 illustrates a multi-duct nozzle according to an example embodiments of the present disclosure.

Nozzle 206 may be provided in various forms. For example, in a low pressure application, a Delaval nozzle may be employed. By way of further example, in a high-pressure application, a supersonic nozzle may be employed. Additionally, in some embodiments it may be desirable to spray a relatively large area in a single pass, for example to decrease cycle times associated with solid state deposition. Accordingly, multiple nozzles may be employed. Alternatively, as illustrated in FIG. 4, a nozzle 206 including multiple ducts 214 may be employed to spray over a relatively wider area than a nozzle including a single duct. Thus, in some embodiments the solid state deposition may be completed in a single-pass.

As noted above, according to one embodiment of the present disclosure, solid state deposition (e.g., cold spray) can be used to enhance the cosmetic appearance of a joint. For example, solid state deposition can be used to enhance the cosmetic appearance of a friction stir processed part. Friction stir processing can refer broadly to any of the following: friction stir welding, friction stir mixing, friction surfacing, friction hydro pillar processing, friction stir forming; friction extrusion; and friction stir spot welding. Solid state deposition can be used to apply a consistent microstructure to the surface of a friction stir welded part, thereby eliminating cosmetic defects that typically occur when anodizing friction stir processed parts. Solid state deposition can deposit a layer of material at the joint (e.g., at the friction stir processed area) that will alter the reflectivity at the area of deposition to enhance the cosmetic appearance. Solid state deposition across the joint (e.g., across the friction processed area) can eliminate the visibility of the joint line, as discussed below.

Figure 5:
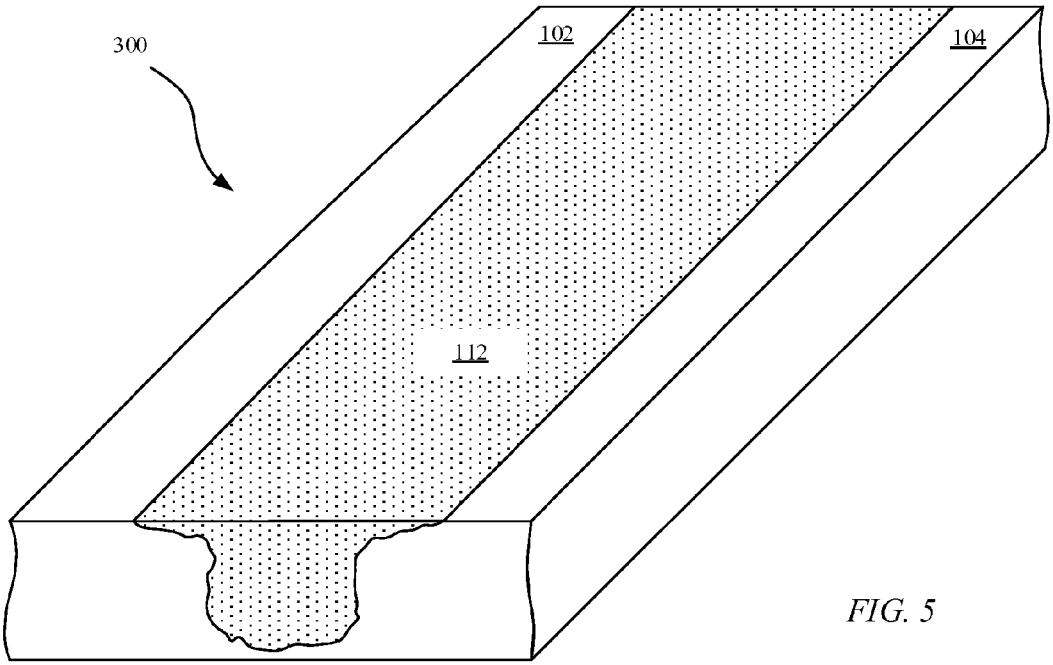
FIG. 5 illustrates a friction stir processed part according to an example embodiment of the present disclosure.

FIG. 5 shows a representation of friction stir processed part 300 having friction stir welded portion 112 disposed between joined substrates 102 and 104. Because of the varied properties of material within the friction stir welded portion 112, without further processing a difference in appearance may be evident between the friction stir welded portion 112 and adjacent portions of joined substrates 102 and 104.

Figure 6:
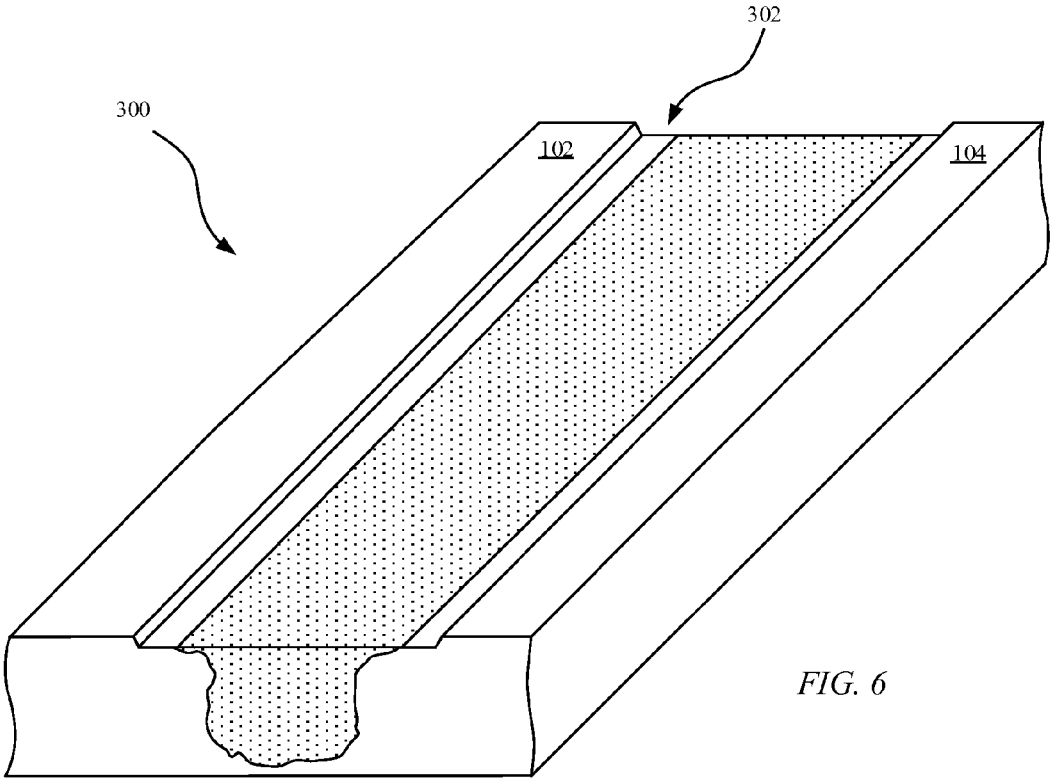
FIG. 6 illustrates the friction stir processed part of FIG. 5 after machining a channel at a friction stir processed portion thereof according to an example embodiment of the present disclosure.

FIG. 6 illustrates a trough or channel 302 machined along a top portion of the friction stir welded portion 112 of the friction stir processed part 300. In this way, a portion of the material affected by the friction stir welding operation can be machined away from a cosmetic top surface of the friction stir processed part 300. While channel 302 is depicted as being substantially flat, channel 302 can have any other geometry conducive to use with the disclosed embodiments.

Figure 7:
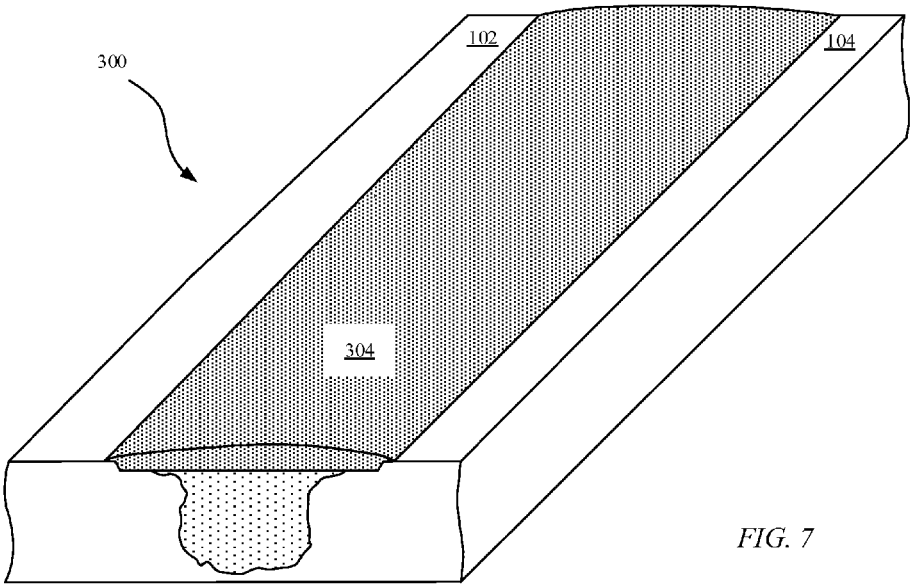
FIG. 7 illustrates the friction stir processed part of FIG. 6 after filling the channel with a solid state deposition layer according to an example embodiment of the present disclosure.

FIG. 7 illustrates a solid state deposition (e.g., cold spray) layer 304 used to fill the channel 302. As depicted, the solid state deposition layer 304 may be disposed slightly above a surface of the friction stir processed part 300. In some embodiments, as depicted, the cold spray 304 can be shaped such that it tapers in a direction toward the cosmetic surfaces of the joined substrates 102 and 104. Alternatively or additionally, excess portions of the solid state deposition layer 304 can be mechanically finished such that the solid state deposition layer blends in with the rest of friction stir welded part 300. In another embodiment, the solid state deposition layer may define a thickness and shape configured to match the surrounding outer surface of the friction stir processed part 300.

Figure 8:
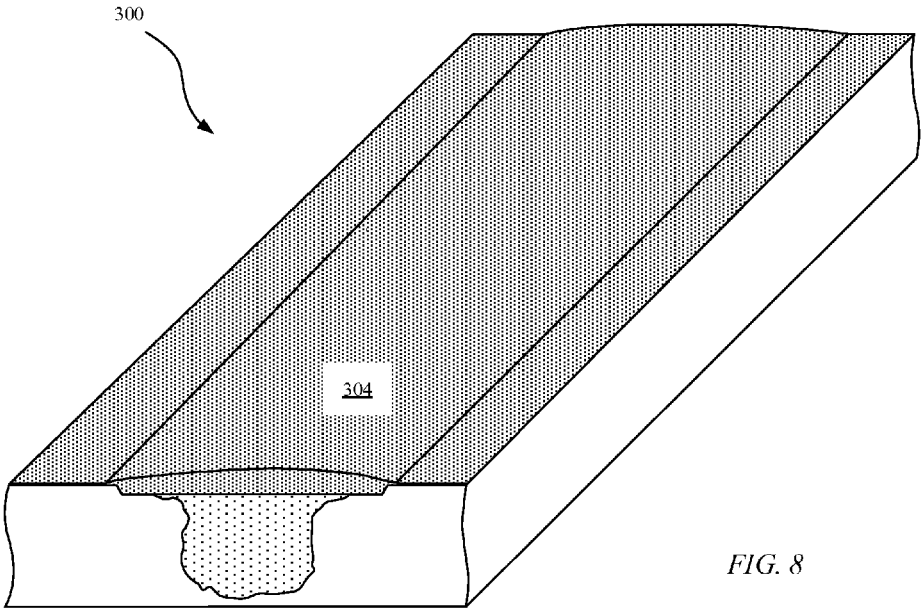
FIG. 8 illustrates the friction stir processed part of FIG. 6 after filling the channel and coating a remainder of a surface of the friction stir processed with a solid state deposition layer according to an example embodiment of present disclosure.

FIG. 8 shows yet another embodiment in which the solid state deposition layer 304 not only fills channel 302, but also covers additional portions of the exterior of the friction stir processed part 300. In some embodiments, the exterior of the friction stir processed part 300 may be substantially covered by the solid state deposition layer 304. However, in other embodiments the solid state deposition layer 304 may cover a side or panel of the friction stir processed part 300 at which the channel 302 is located. Regardless, any difference in coloration or reflectivity between friction stir processed part 300 and the solid state deposition layer 304 may be less noticeable, since there may be substantially no variation in color or reflectivity within a single panel or side thereof.

Figure 9:
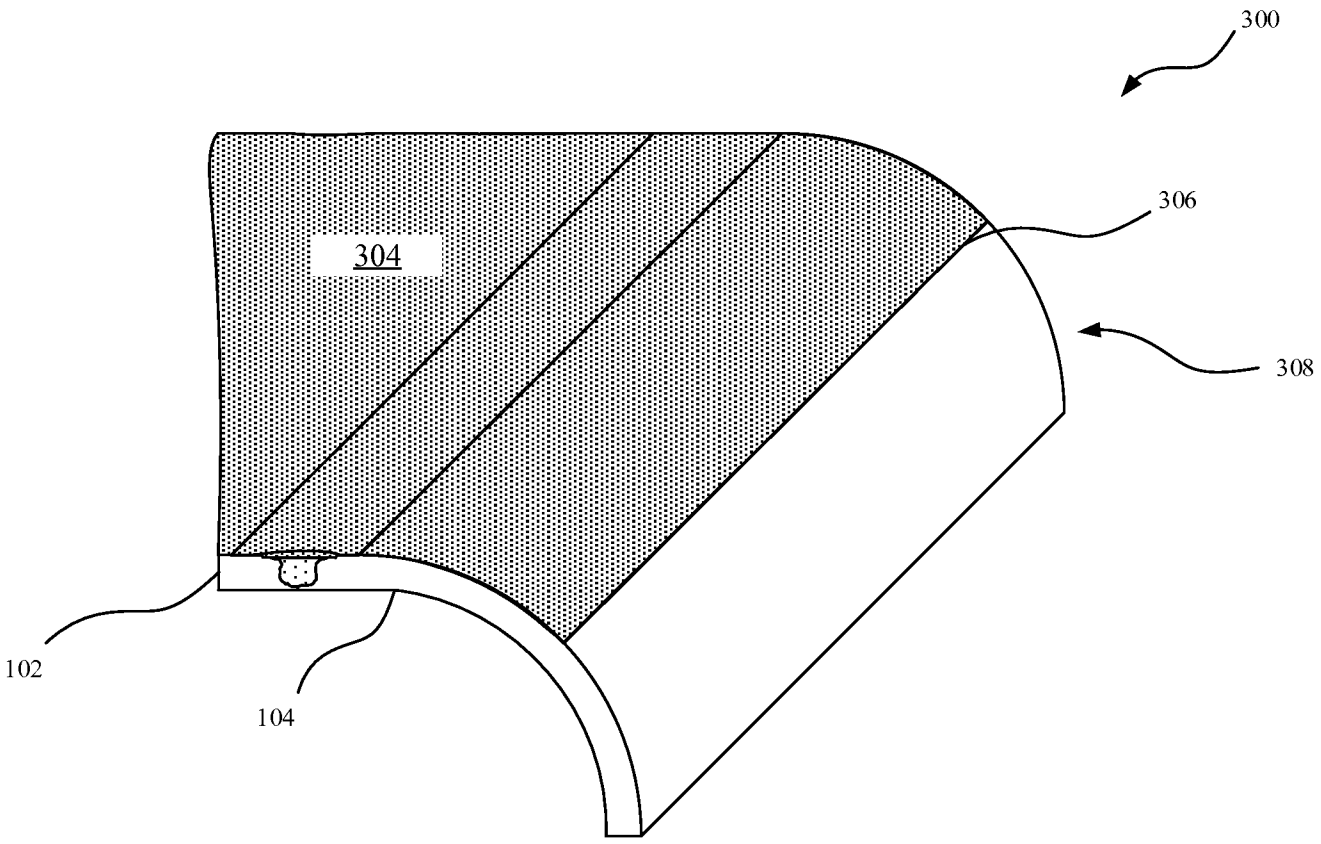
FIG. 9 illustrates the friction stir processed part of FIG. 6 after filling the channel and coating the friction stir processed part with a solid state deposition layer to a boundary at a curved surface according to an example embodiment of present disclosure.

In one embodiment the solid state deposition layer 304 extends only to a proximate geometric feature such as an edge feature characterized by a substantial curve or corner feature. It should be noted that curves associated with edge features tend to mask any slight differences that can be present between the solid state deposition layer 304 and the material defining the joined substrates 102, 104. In particular, as illustrated in FIG. 9, a boundary 306 between the solid state deposition layer 304 and the material defining the friction stir processed part 300 may be oriented perpendicularly to the curvature of a curved surface 308 of the friction stir processed part to more effectively conceal any variations in color or reflectivity.

Figure 10:
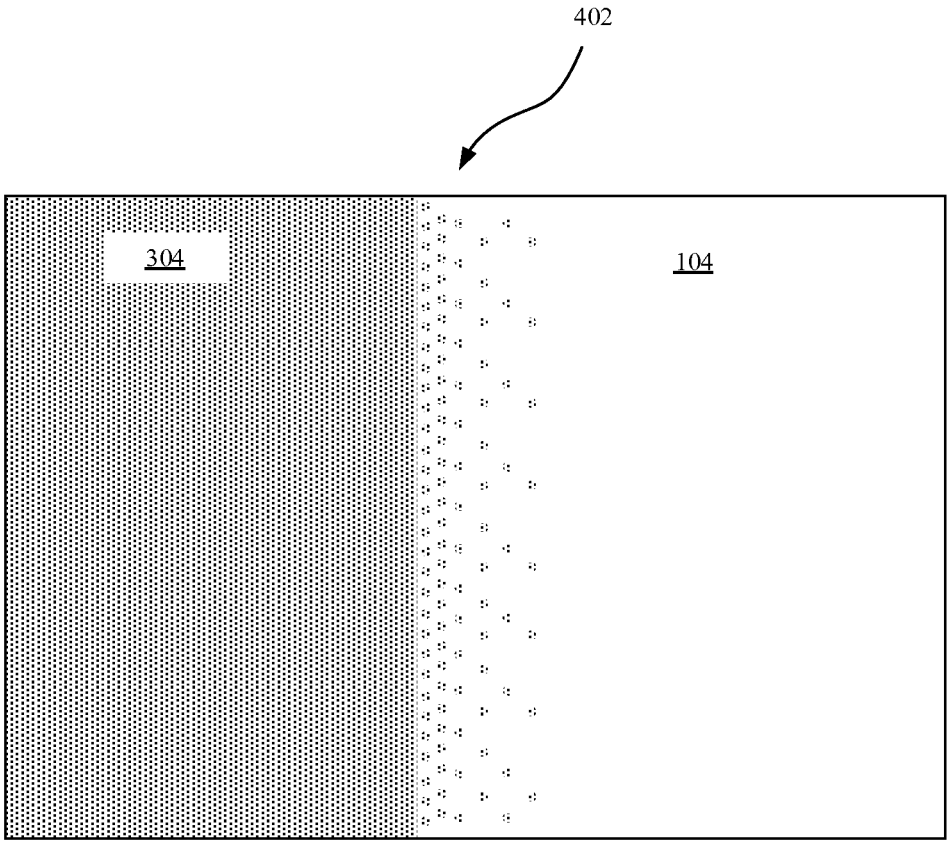
FIG. 10 illustrates a top view of feathering of a solid state deposition layer at the boundary with a substrate according to an example embodiment of the present disclosure.

FIG. 10 shows how a boundary 402 between the solid state deposition layer 304 and substrate 104 can be feathered (e.g., blended via dispersed application of the powder particles) to hide any differences in color or reflectivity of the two materials together. Because the solid state deposition layer 304 is generally deposited in a spray pattern, a certain amount of feathering can be expected as long as there is no masking in place to make a fine line between the two materials. Additional feathering of the boundary 402 can be achieved with reduced application of the particles defining the solid state deposition material along the boundary 402. It should be noted that a finishing operation can also be configured to reduce a thickness of the solid state deposition material 304 at the boundary 402 such that the feathering effect is further enhanced.

Figure 11:
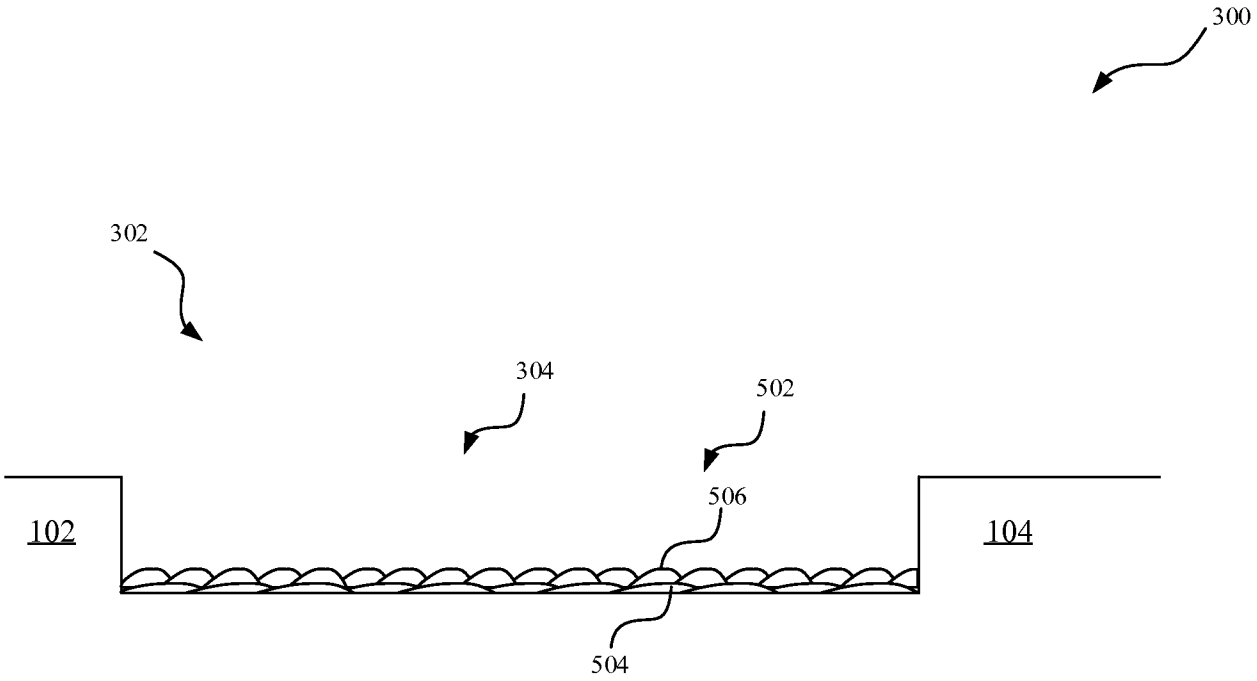
FIG. 11 shows a cross-sectional side view of a solid state deposition layer deposited within a channel according to an example embodiment of the present disclosure.

FIG. 11 shows a cross-sectional side view of the friction stir processed part 300, with the channel 302 partially filled by the solid state deposition layer 304. As the solid state deposition layer 304 is deposited in the channel 302, a kinetic energy associated with each metallic nanoparticle 502 defining the solid state deposition layer 304 can cause the metallic nanoparticles 502 to deform and adhere to a targeted substrate. Higher kinetic energy can enable the metallic nanoparticles 502 to be flattened to a greater extent while lower kinetic energy results in a rounder geometry. For example, in the illustrated embodiment, first metallic nanoparticles 504 (flattened) arranged along a bottom surface of channel 302 were deposited at a higher kinetic energy than second metallic nanoparticles 506 (rounded) shown just above the bottom surface.

Because the solid state deposition layer 304 is generally free of impurities, a resulting finished surface of the solid state deposition layer can be significantly smoother than material making up the joined substrates 102, 104, and hence the solid state deposition layer 304 may be relatively more reflective than the joined substrates. However, by applying the solid state deposition layer 304 at lower kinetic energy levels (e.g., second metallic nanoparticles 506), a surface with relatively rounded features can be achieved that can provide a matte surface consistency. In some configurations, the matte surface produced by lower kinetic energy metallic nanoparticles 502 can produce a surface finish that substantially matches a remaining portion of friction stir processed part 300. In such a configuration an etching step could be skipped, as further machining could cause a high reflectivity associated with nanoparticles 502 to return, making differences between the solid state deposition layer 304 and the substrates 102, 104 more evident.

In some embodiments, the grain size of deposited particles can be varied to match a cosmetic surface of friction stir processed part 300. In this regard, larger particles may tend to extend outwardly further from the remainder of the solid state deposition layer 304 with relatively deep channels therebetween, and hence produce a matte finish. Conversely, smaller particles may tend to extend outwardly from the remainder of the solid state deposition layer 304 to a lesser extent with relatively shallow channels therebetween, and hence produce a smoother and more reflective finish.

In yet another embodiment, a powdered precipitate such as for example, Magnesium Silicide, or Iron can be added to the nanoparticles 502. The powdered precipitate can reduce a resulting reflectivity of the surface of the solid state deposition layer 304 and allow it to blend more evenly with joined substrates 102, 104. A mixture ratio of powdered precipitate can be varied such that the resulting solid state deposition layer substantially matches the substrate In any case it should be noted that in one embodiment the solid state deposition layer should have a depth of at least about 20 microns. In this manner, an applied anodization layer will not erode through the solid state deposition layer 304 and reach substrates 102, 104.

Figure 12:
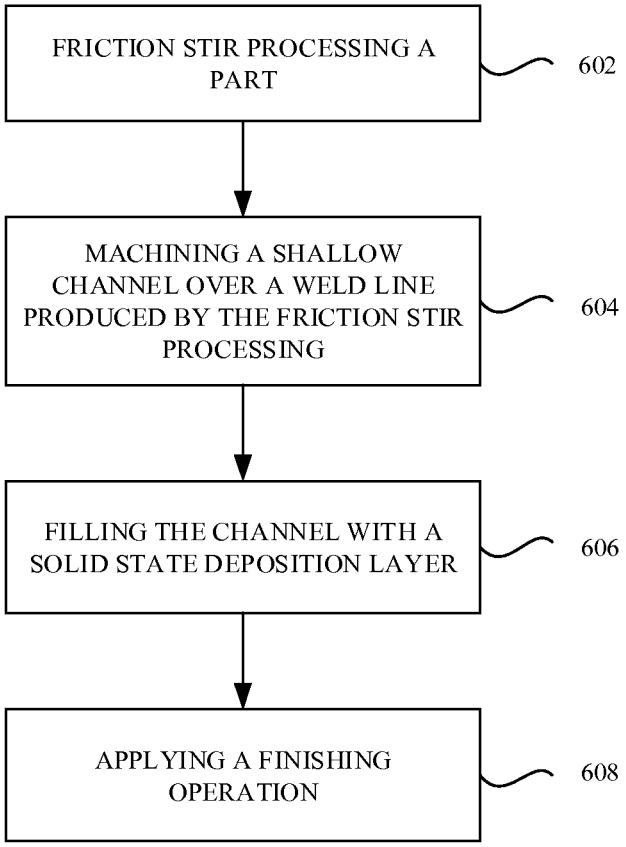
FIG. 12 illustrates a block diagram of a method for applying a solid state deposition layer to improve cosmetics of a friction stir processed part according to an example embodiment of the present disclosure.

FIG. 12 shows a block diagram of a method for applying a solid state deposition layer to improve cosmetics of a friction stir processed part. In step 602 a friction stir processing step is applied to a part. In step 604 a shallow channel is machined over a weld line produced by the friction stir processing step. In step 606 a solid state deposition layer is applied to fill in the shallow channel. In step 608 a series of finishing steps are applied over the solid state deposition layer to blend the solid state deposition layer in with the rest of the friction stir processed part. Note that although the method is generally described herein as being applicable to parts subjected to friction stir processing operations, application of a solid state deposition layer may also be employed to improve the cosmetics of parts joined by various other methods and to improve the appearance of various parts regardless of whether there is a joint therebetween.

Figure 13:
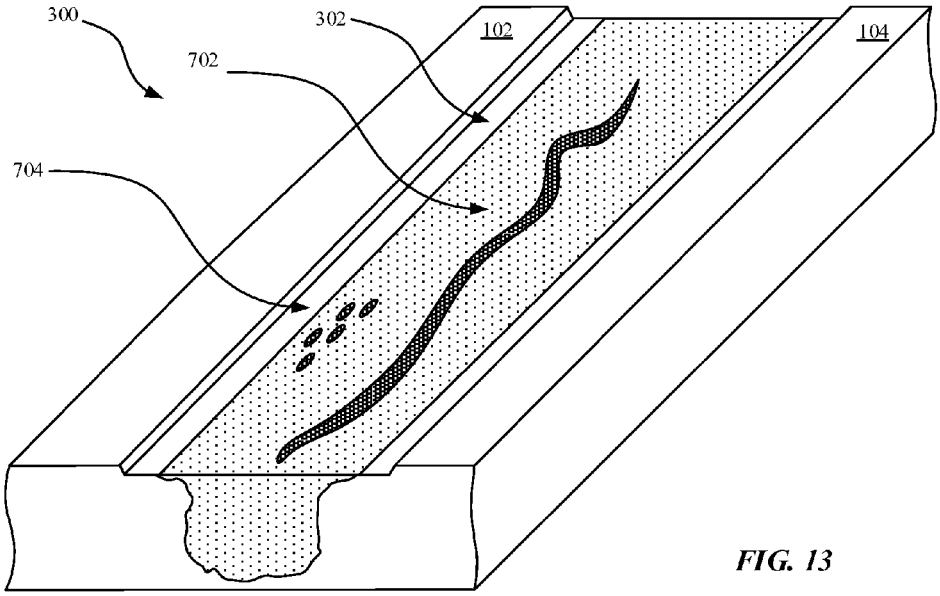
FIG. 13 illustrates a friction stir processed part including defects according to an example embodiment of the present disclosure.
Figure 14:
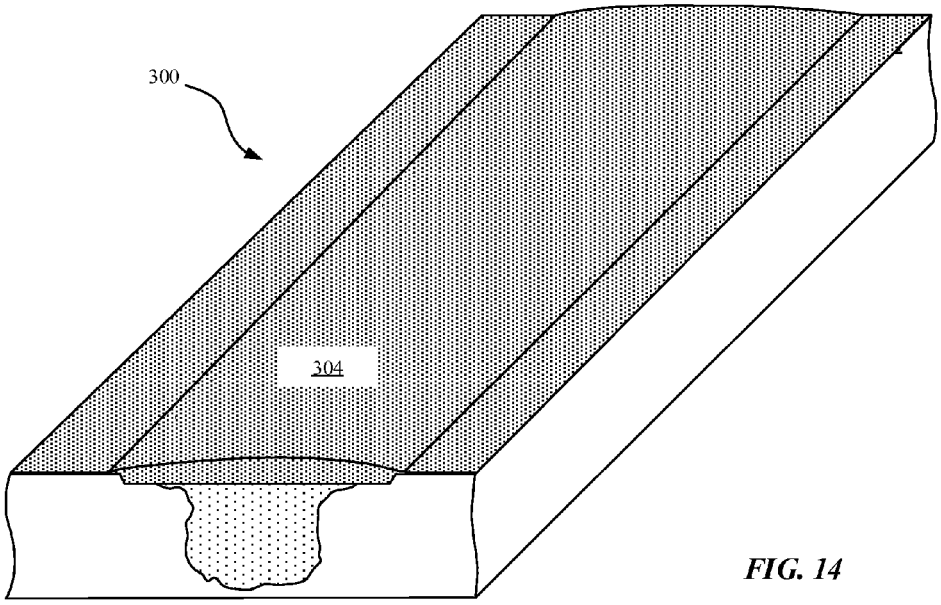
FIG. 14 illustrates the friction stir processed part of FIG. 13 after solid state deposition repair according to an example embodiment of the present disclosure.

FIG. 13 shows how a friction stir processed piece can include a cracked region 702 and pitting 704. Because solid state deposition may produce a sturdy and reliable material, in addition to the above-discussed cosmetic benefits, solid state deposition can be used to fix cosmetic and structural defects. Cracked region 702 shown in FIG. 13 can be filled as part of a solid state deposition operation designed to fill in channel 302. A solid-state deposition 304 layer, as depicted in FIG. 14, can also mask pitting 704 (shown in FIG. 13). Furthermore, in cases where a friction stir weld seam between the friction stir welded region and the joined substrate is not fully engaged, the solid state deposition layer 304 can fill in and solidify such a gap. Similarly, the solid state deposition layer 304 can be utilized to remedy other cosmetic imperfections disposed along the friction stir processed piece.

Detection of defects (e.g., described above) and subsequent repair of defects may be determined by a visions system (e.g., CCD imaging system, camera) used to detect defects. Also, a robotic finishing system may provide an automated means for a finishing profile, resulting in repair of the defects. An automated method for using an imaging system to detect defects used in conjunction with a robotic finishing system can be found in U.S. Patent Publication 2013-0238111, to Whipple et al., the disclosure of which is hereby incorporated by reference in its entirety.

Figure 15:
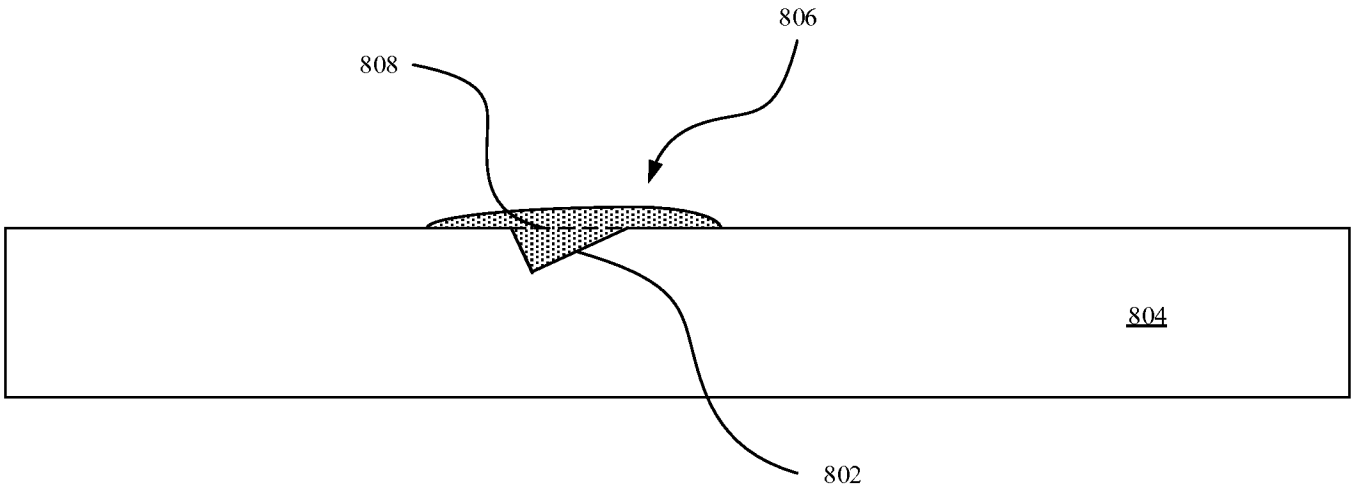
FIG. 15 illustrates repair of a recess in a substrate using solid state deposition according to an example embodiment of the present disclosure.

FIG. 15 illustrates a repair process of an unwanted recess 802 (e.g., a ding, dent, scratch, etc.) in a substrate 804. As illustrated, a solid state deposition 806 may be deposited in the recess 802. In the illustrated embodiment the solid state deposition 806 extends out of the recess 802 beyond the surrounding exterior surface of the substrate 804. In this regard, the solid state deposition 806 may be machined down to a height 808 matching the surrounding exterior surface of the substrate 804. However, in another embodiment the solid state deposition 806 may be initially deposited such that it matches the shape of the surrounding exterior surface of the substrate 804. Accordingly, as described above, solid state deposition may be employed to repair damage to products, regardless of whether the damage exists at a weld or not.

Figure 16:
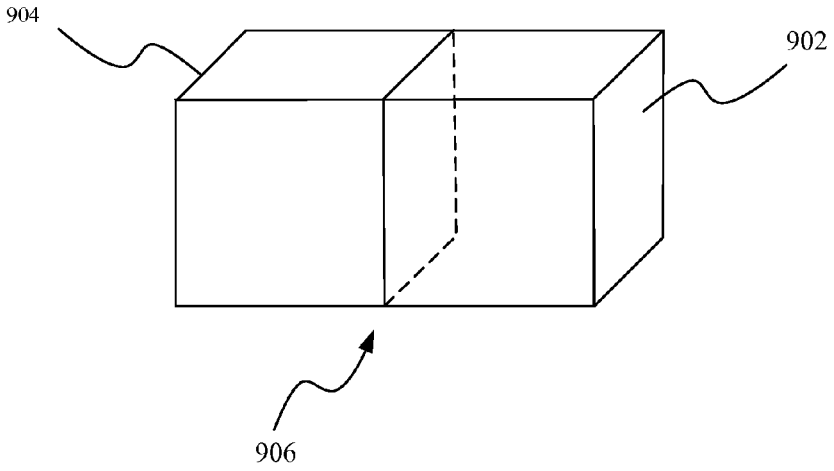
FIG. 16 illustrates two parts in contact along a planar interface in preparation for attachment according to an example embodiment of the present disclosure.
Figure 17:
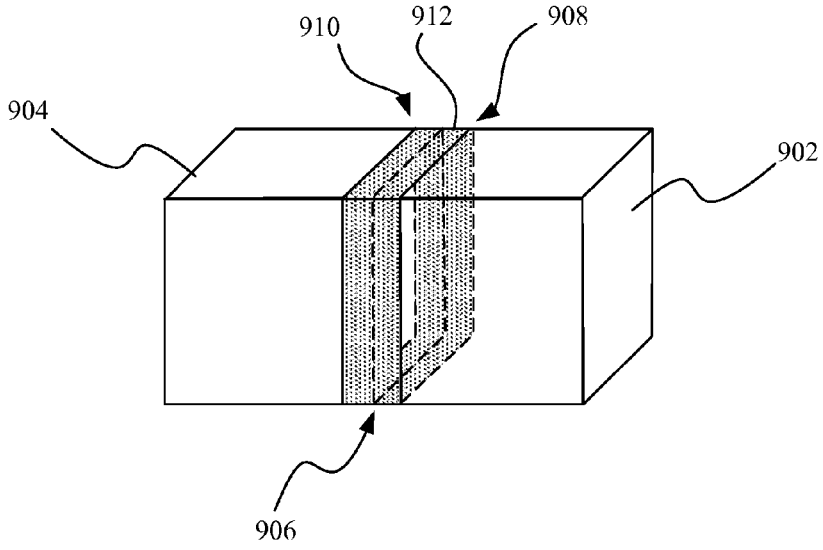
FIG. 17 illustrates the two parts of FIG. 16 joined by solid state deposition according to an example embodiment of the present disclosure.

Solid state deposition may also be employed for other purposes. In this regard, solid state deposition may be employed in joining two or more parts, as illustrated in FIGS. 16 and 17. FIG. 16 shows a first part 902 and a second part 904 in contact at a planar interface 906. Instead of using the solid-state deposition to cover a friction stir processed weld line in the manner discussed above, the solid-state deposition can itself be operable to join the parts 902, 904 together. More particularly, the parts 902, 904 can be joined together at the interface 906 by applying solid state deposition 912 to respective outer surfaces 908, 910 of the parts 902, 904 proximate the interface, as depicted in FIG. 17. Accordingly, the solid state deposition 912 can extend across both sides of the interface 906 to join the parts 902, 904 together.

Figure 18:
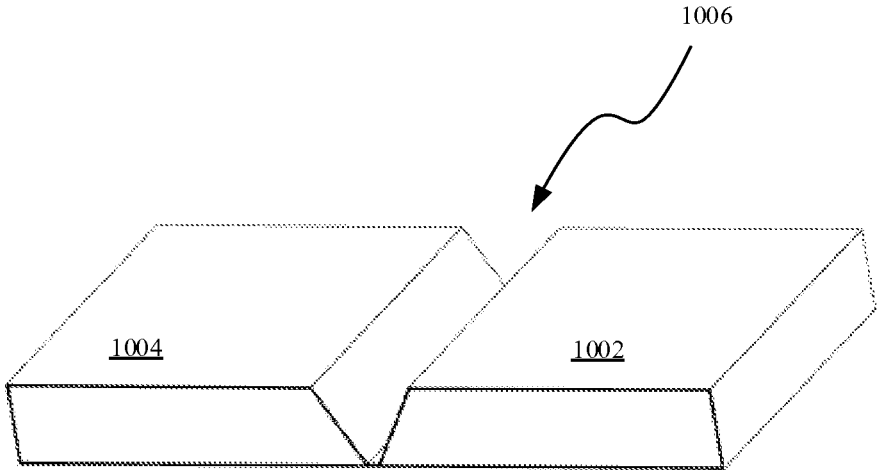
FIG. 18 illustrates two parts arranged with an interface groove positioned therebetween in preparation for attachment according to an example embodiment of the present disclosure.
Figure 19:
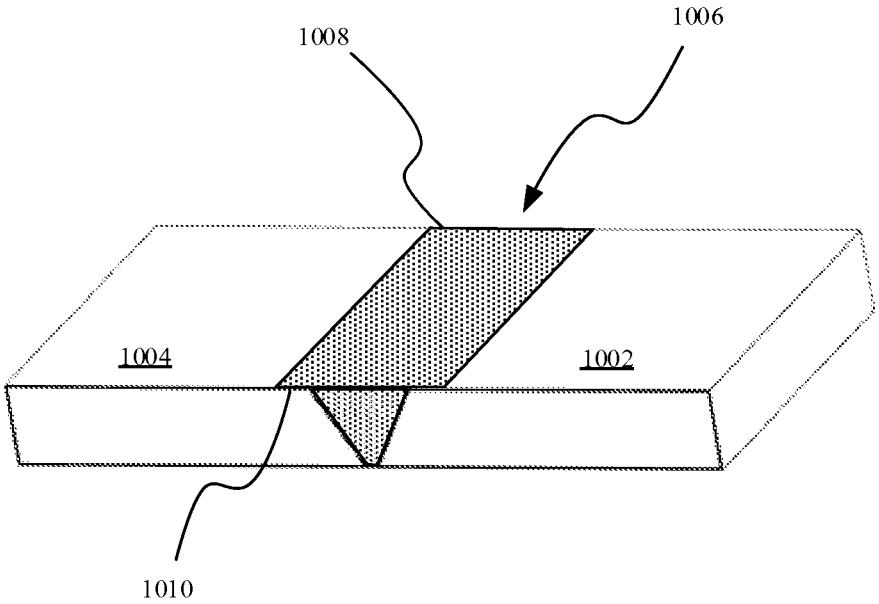
FIG. 19 illustrates the two parts of FIG. 18 joined by solid state deposition according to an example embodiment of the present disclosure.

Alternatively, an interface trough or groove 1006 can be arranged between a first part 1002 and a second part 1004, as depicted in FIG. 18. In this case, a solid state deposition 1008 can be applied within the groove 1006, as depicted in FIG. 19. In this regard, particles largely follow substantially linear pathways during deposition. By providing the groove 1006, the particles may be directed onto exposed surfaces to which the particles may bond and successive particles may build upon one another to form the solid state deposition 1008 coupling the parts 1002, 1004. Use of such a groove 1006 may thus improve the strength of the coupling between the parts 1002, 1004 as compared to the joint created by the planar interface illustrated in FIGS. 16 and 17. Further, as illustrated, in some embodiments the solid state deposition 1008 can cover an area 1010 extending away from interface groove 1006 so that peripheral edges of the solid state deposition 1008 can be feathered or blended with the parts 1002, 1004 for an improved cosmetic appearance.

The foregoing embodiments shown in FIGS. 20-29 include various methods of using a solid state deposition in order to engage one or more structures. The structure may be made of materials previously described for a substrate (e.g., aluminum, etc.). The substrates described below may, for example, be part of an enclosure of an electronic device (e.g., laptop computing device, mobile computing device, desktop computing device).

Solid state depositions may be relatively strong when exposed to compressive forces. However, use of solid state deposition to join two or more parts may have certain limitations. In this regard, solid state depositions may be relatively brittle, depending on the material deposited, as a result of the plastic deformation occurring during impact with the substrate. Thus, the strength of a joint formed by a solid state deposition may be relatively weak when exposed to tension. For example, the joint formed by a solid state deposition may be relatively weak when exposed to a drop test. Therefore, it may be desirable to provide joints formed by solid state depositions with features configured to provide the joints with extra strength.

Figure 20:
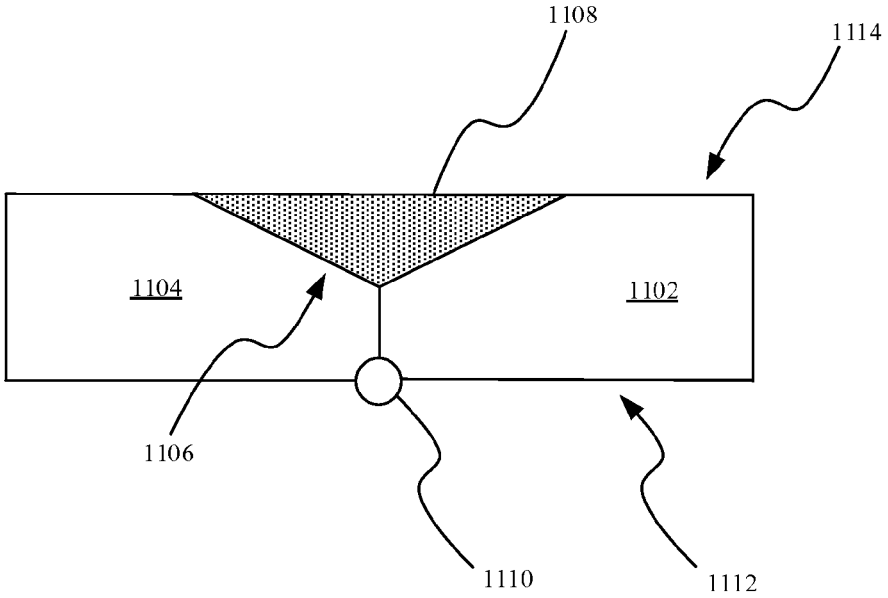
FIG. 20 illustrates two parts joined by solid state deposition and laser welding according to an example embodiment of the present disclosure.

For example, FIG. 20 illustrates a side view of first and second parts 1102, 1104 with a groove 1106 positioned therebetween that is filled with a solid state deposition 1108. In addition, a weld 1110 is also provided. As illustrated, weld 1110 (e.g., a laser weld) may be provided at an interior surface 1112 opposite from an exterior surface 1114 at which the solid state deposition 1108 is positioned. In this regard, the solid state deposition 1108 may provide a cosmetic appearance that substantially matches that of the parts 1102, 1104 with additional strength provided by weld 1110 to the joint. Thus, the weld 1110 may be hidden at the interior surface 1112, whereas the solid state deposition 1108 may be positioned at the exposed outer surface 1114. Further, by positioning weld 1110 at the interior surface 1112, the heat affected zone caused by the weld 1110 may not extend to the exterior surface 1114 such that the above-noted cosmetic defects associated with welding may not be of concern. Further, weld 1110 may be formed prior to depositing the solid state deposition 1108 in some embodiments. Accordingly, issues with respect to a heat affected zone extending through the solid state deposition 1108 may be avoided.

Figure 21:
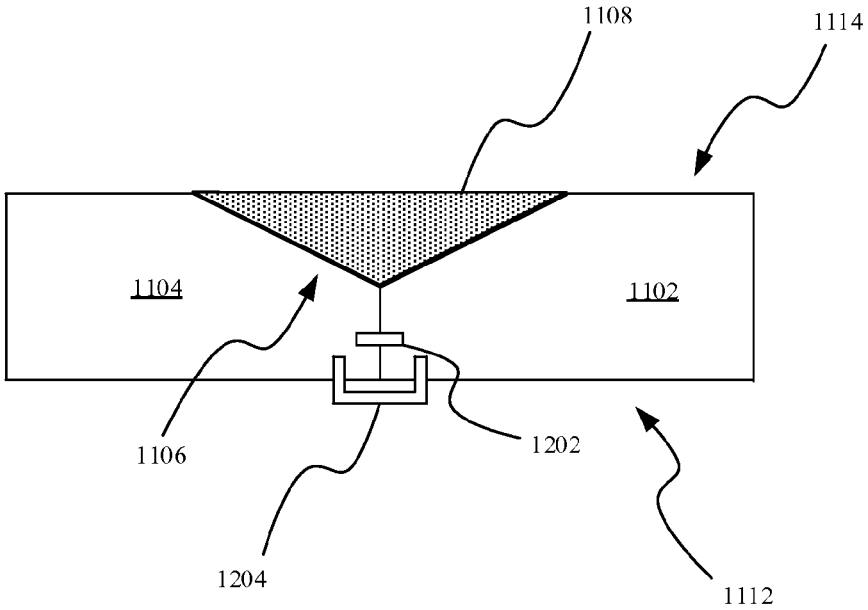
FIG. 21 illustrates two parts joined by solid state deposition and mechanical fasteners according to an example embodiment of the present disclosure.

FIG. 21 illustrates an alternate embodiment of a configuration for providing extra strength to the joint between the parts 1102, 1104. In particular, FIG. 21 illustrates mechanical fasteners 1202, 1204 joining the parts. In some embodiments, fastener 1202 is a pin or a screw. In some embodiments, fastener 1204 is a clamp mechanism. Mechanical fasteners 1202, 1204 may be employed to hold the parts 1102, 1104 to strengthen the joint therebetween, or various other mechanical fasteners may be employed. As illustrated, mechanical fasteners 1202, 1204 may be positioned away from the exterior surface 1114 so that mechanical fasteners 1202, 1204 are not visible.

Figure 22:
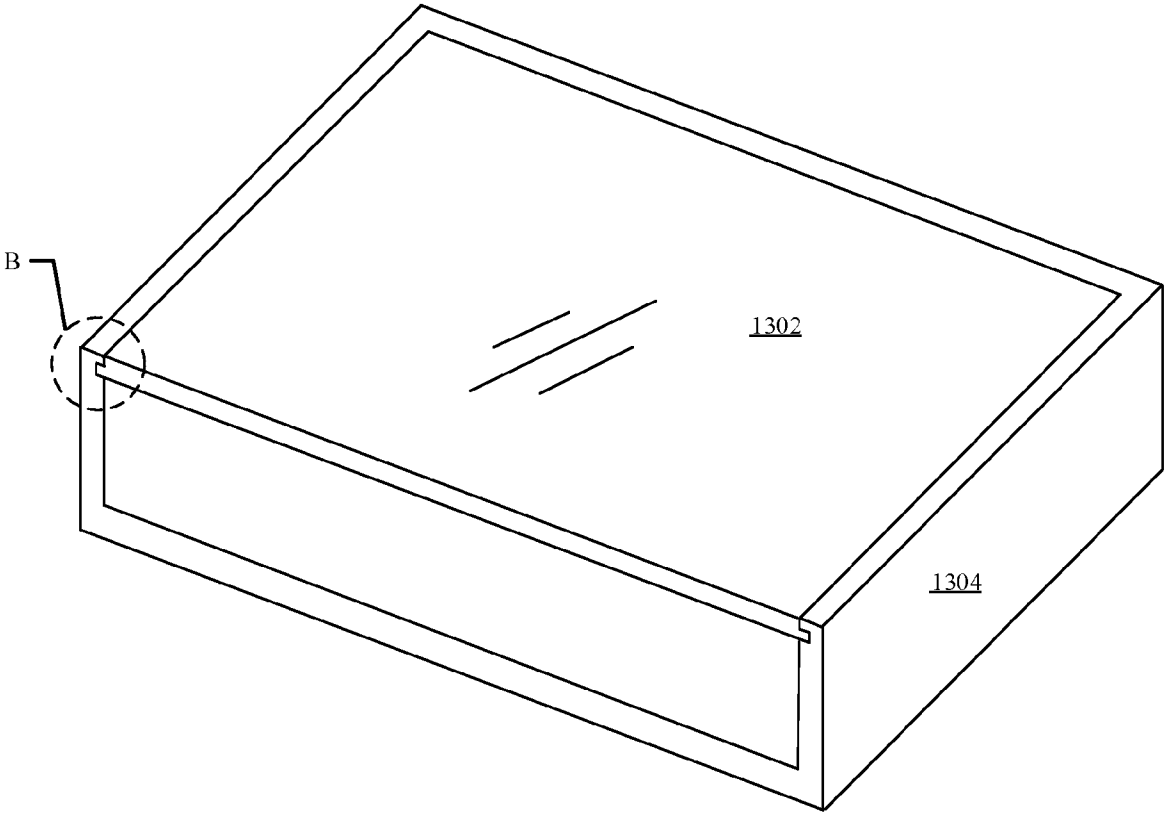
FIG. 22 illustrates a lid coupled to a housing according to an example embodiment of the present disclosure.
Figure 23:
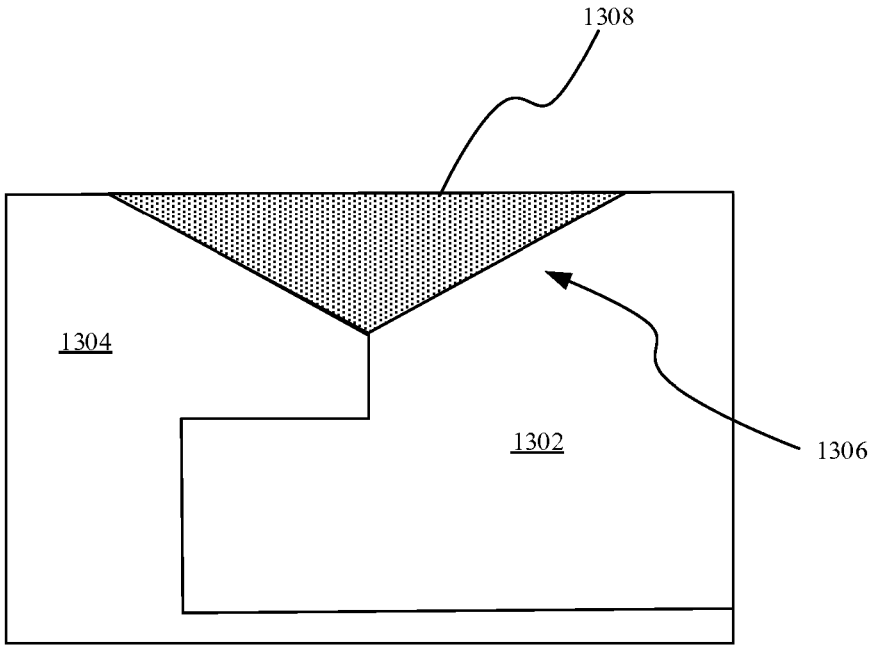
FIG. 23 illustrates an enlarged view of area B from FIG. 22 including a joint between the lid and the housing joined by interlocking features and solid state deposition according to an example embodiment of the present disclosure.

Various other mechanisms may be employed to strengthen a joint formed by a solid state deposition. In this regard, FIG. 22 illustrates lid 1302 coupled to a housing 1304. An enlarged view of area B is illustrated in FIG. 23. As illustrated in FIG. 23, lid 1302 and housing 1304 may define a groove 1306 filled by a solid state deposition 1308. Further, lid 1302 and housing 1304 include interlocking features. In some embodiments, the interlocking feature is a dovetail configured formed within a portion of lid 1302 and housing 1304. In the embodiment shown in FIG. 23, the interlocking feature is a tongue and groove configuration. Generally, the interlocking feature may be any configuration that provides the joint with additional strength.

Figure 24:
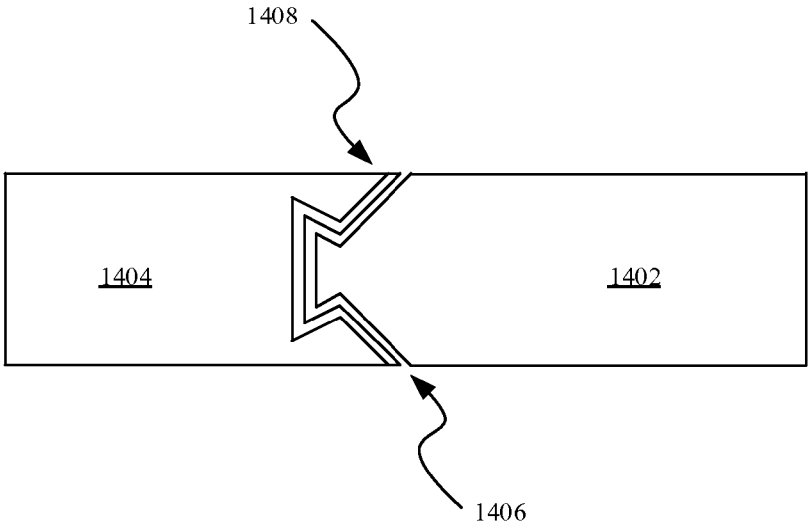
FIG. 24 illustrates two parts joined by interlocking features with a tapered surface and solid state deposition according to an example embodiment of the present disclosure.

FIG. 24 illustrates an additional embodiment of joint formed by first and second parts 1402, 1404 that include interlocking features configured to mechanically strengthen the joint. A groove 1406 between the parts 1402, 1404 may provide for receipt of a solid state deposition (not shown). Further, one or both of the parts 1402, 1404 may define a tapered end 1408 that allows for deposit of the solid state deposition thereon by assisting in defining the groove 1406.

Figure 25:
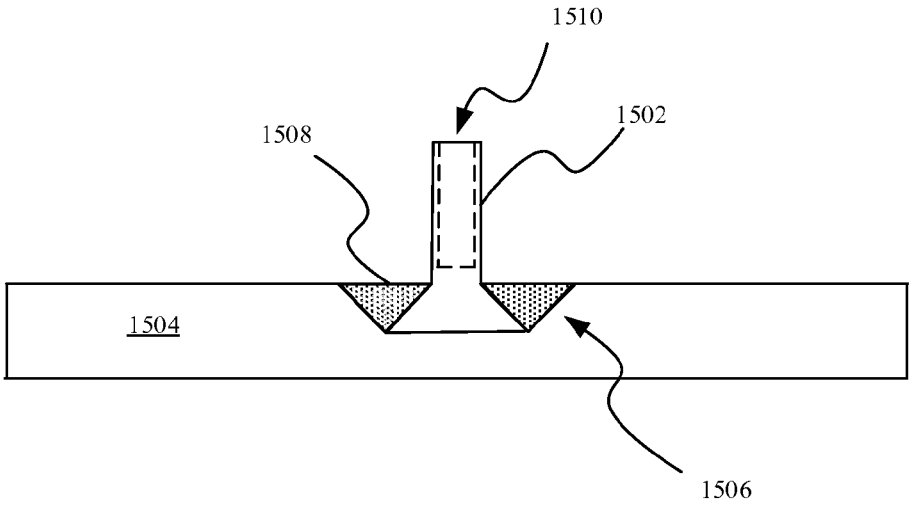
FIG. 25 illustrates a boss joined to a substrate via solid state deposition according to an example embodiment of the present disclosure.
Figure 26:
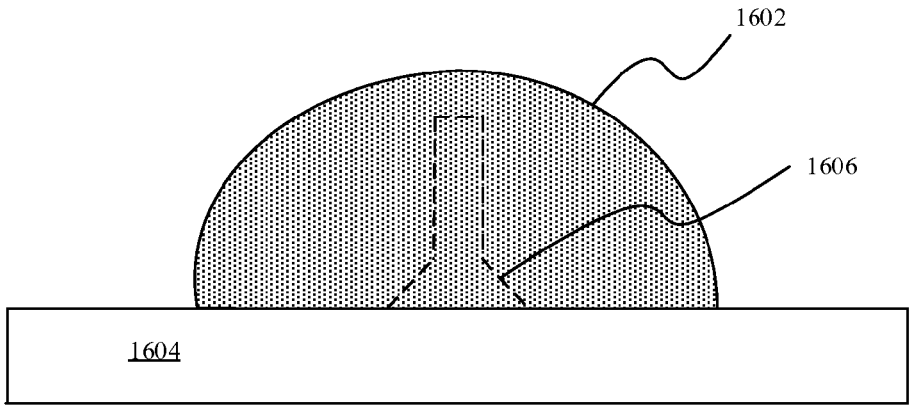
FIG. 26 illustrates formation of a boss from a solid state deposition according to an example embodiment of the present disclosure.

FIGS. 25 and 26 illustrate an additional structure formed within a solid state deposition layer. Although a single substrate is shown, a pair of substrates may be joined by any means previously described. FIG. 25 illustrates boss 1502 joined to substrate 1504 via solid state deposition. In the illustrated embodiment groove 1506 surrounds the boss 1502 and a solid state deposition 1508 is received within groove 1506. As illustrated, groove 1506 may be defined by boss 1502 and the substrate 1504. Boss 1502 includes interior portion 1510 configured to receive a fastening device (e.g., screw, rivet). In this manner, substrate 1504 may be mechanically coupled to another substrate (not shown) which may include a portion of an enclosure of an electronic device. In some embodiments, interior portion 1510 is threaded in order to receive a threaded fastening device.

In other embodiments, parts may be manufactured from a solid state deposition. In this regard, FIG. 26 illustrates a solid state deposition 1602 formed on substrate 1604. As illustrated, the solid state deposition 1602 may be machined to form boss 1606 or other structure. By forming boss 1606 in this manner, issues with respect to a heat affected zone causing cosmetic defects may be entirely avoided since no welding is required. Note that in some embodiments a machining step may be skipped. Rather, parts may be directly "3-D printed" using additive manufacturing techniques in conjunction with solid state deposition.

Figure 27:
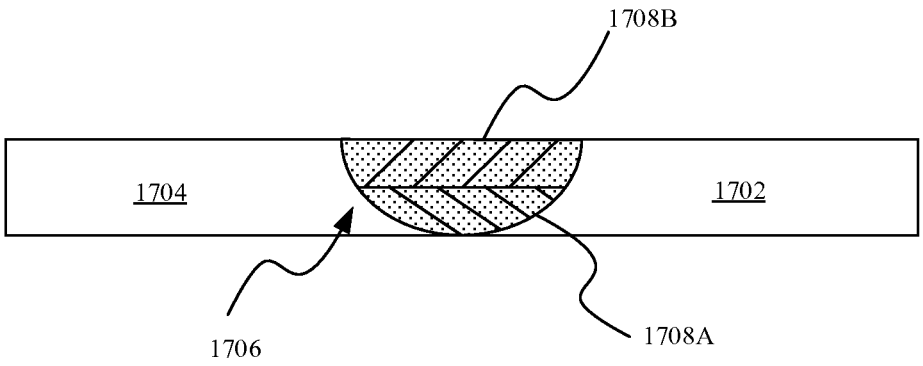
FIG. 27 illustrates solid state depositions comprising differing materials according to an example embodiment of the present disclosure.

Note that although the solid state deposition is generally discussed herein as comprising a single type of material, in other embodiments multiple materials may be employed. For example, FIG. 27 illustrates first and second parts 1702, 1704 with a groove 1706 therebetween. The groove 1706 is filled by a first solid state deposition 1708A comprising a first material and a second solid state deposition 1708B comprising a second material that differs from the first material. The first solid state deposition 1708A is deposited in the groove 1706 first, followed by the second solid state deposition 1708B. Thus, the second solid state deposition 1708B may define a material and configuration configured to match the surrounding material of the parts 1702, 1704 for cosmetic purposes. However, the first solid state deposition 1708A, which may be entirely hidden from view, may be selected to define other desirable characteristics. For example, the first solid state deposition 1708A may include titanium or other material configured to provide the assembly with high strength and light weight, whereas the second solid state deposition 1708B may include aluminum in order to match the surrounding parts 1702, 1704. Note that titanium is not work hardenable, and hence solid-state deposition does not cause it to become brittle. However, various other materials may be employed in other embodiments. It should also be noted that materials may be deposited concurrently to form a mixture of materials. Using FIG. 27 as an example, instead of forming separate layers 1708A and 1708B using sequential solid state deposition processes, a mixture of solid state materials can be formed by performing at least two solid state deposition processes at the same time. The resulting mixture can possess combined properties of the constituent components. The resulting mixture can also be varied depending upon an amount of material deposited, kinetic energy of the deposited material, temperature of the deposited material, and so on. In some embodiments, each species of solid-state material can be deposited using a separate nozzle structure each of which can be controlled independent of each other.

In still another embodiment, the solid-state material can be deposited using a raster scan apparatus. For example, solid-state material in the form of metallic particles can be passed through an electric field subsequent to being emitted from a nozzle. The electric field can have the effect of applying an electric charge to the particles. The electrically charged particle when moving can be affected by a magnetic field that can be used to deflect and direct the deposition of the electrically charged particles.

Figure 28:
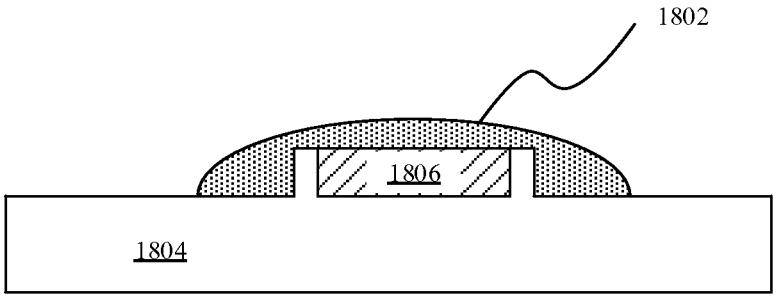
FIG. 28 illustrates formation of a hollow cavity under a solid state deposition according to an example embodiment of the present disclosure.

Solid state deposition may also be employed to form hollow structures. In this regard, FIG. 28 illustrates a solid state deposition 1802 deposited on first part 1804 and temporary part 1806. After the solid state deposition 1802 is formed, temporary part 1806 may be removed. For example, temporary part 1806 may be dissolved or melted. In this regard, temporary part 1806 may include foam, wood, honeycomb, etc. After removal of temporary part 1806, a void may be defined in the space previously occupied by the temporary part, providing the resulting assembly with a lightweight construction.

Figure 29:
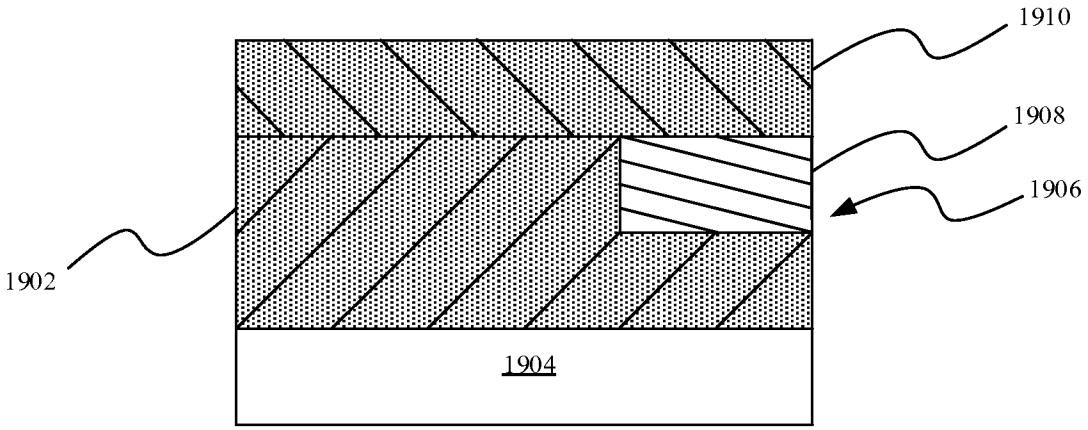
FIG. 29 illustrates formation of an imbedded item within a solid state deposition according to an example embodiment of the present disclosure.

FIG. 29 illustrates formation of an assembly with an embedded structure within a solid state deposition according to an example embodiment of the present disclosure. As illustrated, in one embodiment, a first solid state deposition 1902 may be deposited on substrate 1904. A pocket 1906 may be machined in the first solid state deposition 1902. Embedded structure 1908 may be placed within pocket 1906. Embedded structure 1908 may be selected from a thermally or electrically conductive item. For example, embedded structure 1908 could be copper, graphite, carbon fiber, a heat pipe, etc. Thereafter, a second solid state deposition 1910 may be employed to enclose embedded structure 1908 in pocket 1906.

Figure 30:
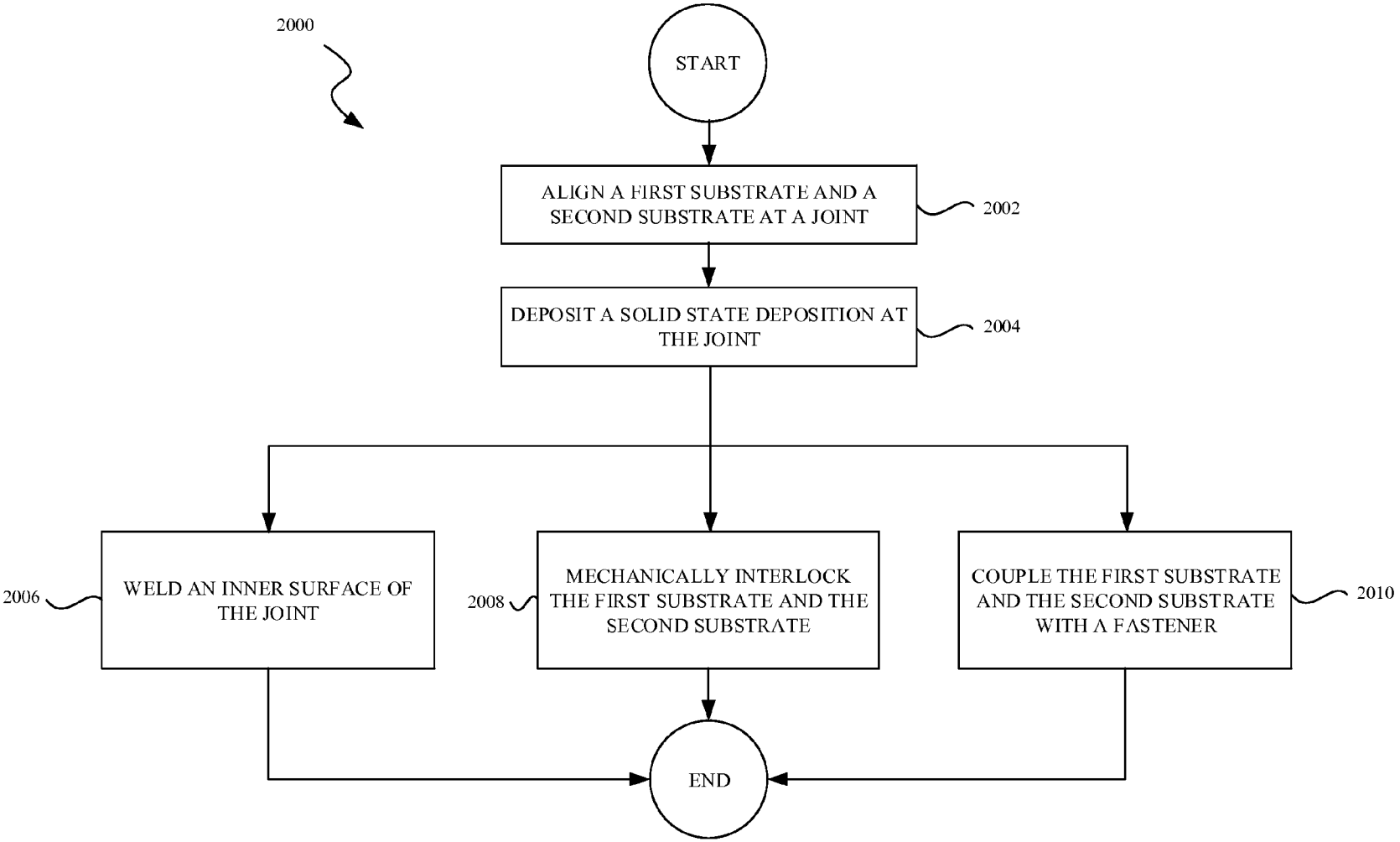
FIG. 30 illustrates a method for forming a joint according to an example embodiment of the present disclosure.

FIG. 30 illustrates a flowchart 2000 showing a method for forming a joint according to an example embodiment of the present disclosure. At step 2002, a first substrate and a second substrate are aligned (with each other) at a joint. At step 2004, a solid state deposition may be deposited at the joint. In some embodiments the solid state deposition may be deposited at an outer surface of the joint in order to provide a cosmetically pleasing appearance, which may match the substrates.

In some embodiments the method may optionally include additional operations. In this regard, at step 2006, an inner surface of the joint is welded. In some embodiments, welding an inner surface (step 2006) may be performed prior to depositing a solid state deposition at the joint (step 2004). In some embodiments, the method includes step 2008, where the first substrate and the second substrate are mechanically interlocked. Also, in some embodiments, the method includes step 2010, which includes coupling the first substrate and the second substrate with a mechanical fastener.

In the embodiments discussed above, solid state deposition is indicated as providing a matching cosmetic appearance with a substrate to which the solid state deposition is applied. However, matching the cosmetic appearance may present certain challenges. In this regard, powders used in solid state deposition are manufactured using an atomizing process. In this process, solutionized alloy powder particles are formed and quenched. Atomized aluminum powder may have a different precipitate distribution than a precipitate hardened substrate of identical chemistry and thus the post-anodized reflectivity may vary from the solid state deposition to the substrate. Further, the texture where the solid state deposition has occurred may be different from the substrate. This may contribute to a slight difference in reflectivity between the deposited region and the substrate. Additionally, the area where material is deposited may be raised compared to the rest of the substrate. In this regard, sharp changes in topology may produce a cosmetic defect.

However, solutions to these potential issues exist as discussed above and hereinafter. In this regard, where the chemistry of the powder and the substrate are similar, the part can be solutionized and then heat-treated after solid state deposition to create a uniform distribution of etching, or pit forming, particles. This should reduce differences in reflectivity from the substrate to the deposited region. Further, precipitate powders, such as $Mg_2Si$ and iron containing intermetallic, can be added to the powder (e.g., AA 6061 powder). These powders may be added in the correct amounts such that the deposition region contains a similar distribution of grain pit forming particles as the substrate. Further, the size of added powder particulates can be defined such that the post deposition size of etching pit forming particles is similar to that of the substrate. This may result in uniform reflectivity from the substrate to the solid state deposition. Additionally, material may be deposited along the weld path such that the width of the deposited layer is greater than the heat affected zone of the weld, in embodiments in which a weld is used. During deposition, the nozzle can decrease slightly in height after each pass to create steps in height from the substrate to the deposition region. Sand blasting may smooth the steps creating a smooth ramp. Flash trimming end-mill may cut a shallow recess over the friction stir processed region, which can be filled by deposited material. End mill passes over the deposition region and surrounding substrate, after deposition, may be employed such that no discontinuity exists in the height of the deposition region and the substrate. Also, the solid state deposition may be feathered when transitioning from the solid state deposition to the substrate.

In various other embodiments the processes described above may be modified. For example, in some embodiments particles defining differing particle sizes may be deposited at the same time to provide the resulting solid state deposition with a more complex surface texture. Further, in some embodiments multiple materials may be deposited at the same time. For example, aluminum and titanium particles may be deposited at the same time in order to take advantage of the properties of each material. In order to account for differences in the conditions required for proper bonding of the particles, the differing materials may be sprayed by respective separate nozzles in some embodiments under differing pressure and/or heat conditions. In another embodiment a magnetic material such as neodymium may be solid state deposited. In this regard, solid state deposition of neodymium may provide benefits in that it does not require extensive heating of the particles, which could otherwise damage the neodymium. Solid state deposition may also be employed to create circuits (e.g., thermal or electrical), by depositing an appropriately conductive material. Further, solid state deposition may be employed to create electrostatic discharge (ESD) shielding, electromagnetic pulse (EMP) shielding, and/or radio frequency (RF) leakage shielding, without damaging the shielded components. Additionally, the solid state deposition may be deposited to define complex structures such as in the form of trusses that provided a lightweight, yet strong, structure rather than in uniform layers.

Variations on traditional solid state deposition apparatuses are also provided herein. In this regard, in one embodiment electrically charged particles ejected from the nozzle may be directed through a magnetic field to direct them to particular location for bonding thereto. For example, the particles may pass through a charged grid after exiting the nozzle. Accordingly, the particles may be deposited in a manner similar to that employed in a cathode ray tube.

Figure 31:
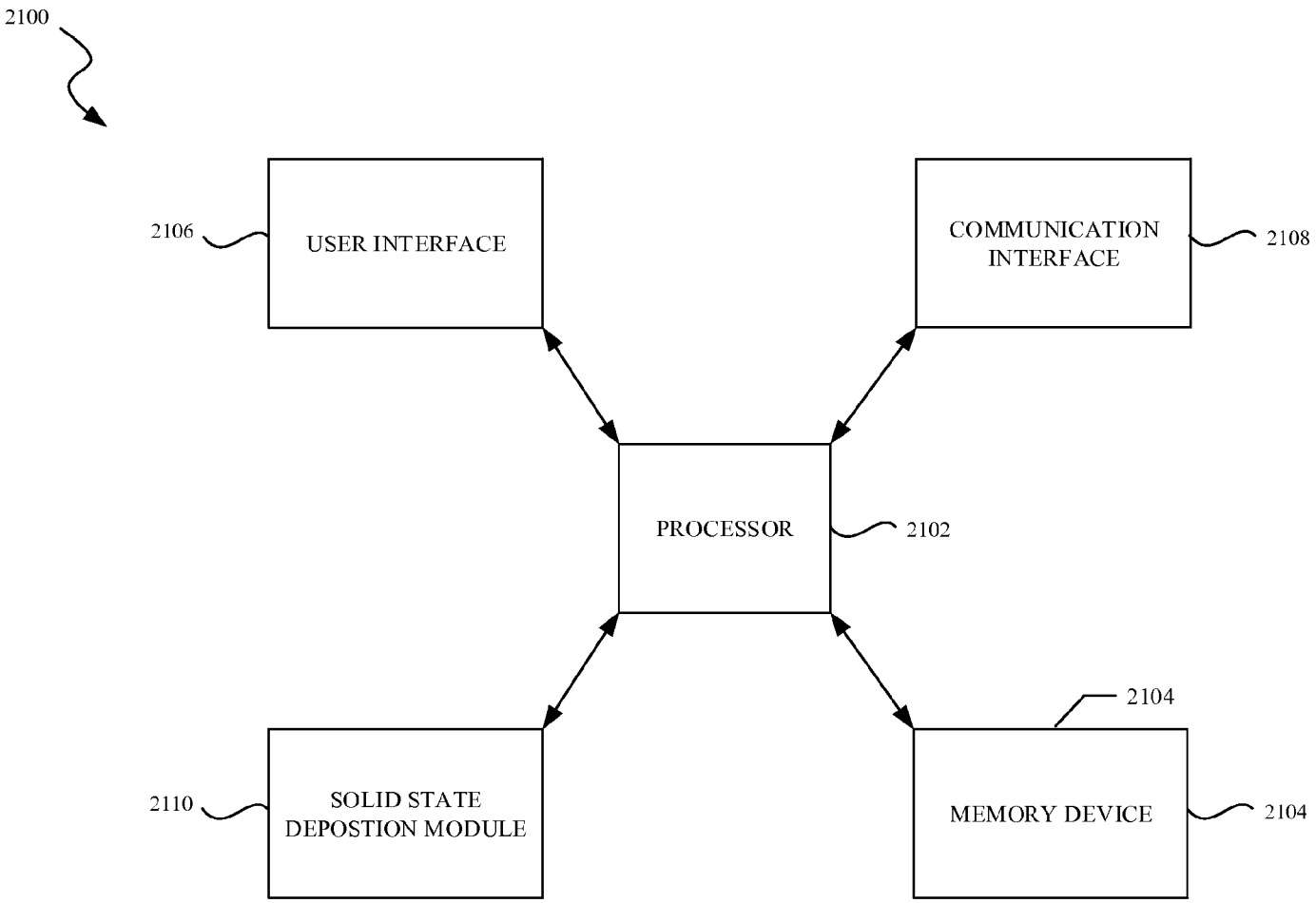
FIG. 31 illustrates a block diagram of an electronic device according to an example embodiment of the present disclosure.

FIG. 31 is a block diagram of an electronic device 2100 suitable for use with the described embodiments. In one example embodiment the electronic device 2100 may be embodied in or as a controller for the cold spray system illustrated in FIG. 3, or other embodiments of a solid state deposition system. In this regard, the electronic device 2100 may be configured to control or execute the above-described solid state deposition operations.

The electronic device 2100 illustrates circuitry of a representative computing device. The electronic device 2100 may include a processor 2102 that may be microprocessor or controller for controlling the overall operation of the electronic device 2100. In one embodiment, the processor 2102 may be particularly configured to perform the functions described herein. The electronic device 2100 may also include a memory device 2104. The memory device 2104 may include non-transitory and tangible memory that may be, for example, volatile and/or non-volatile memory. The memory device 2104 may be configured to store information, data, files, applications, instructions or the like. For example, the memory device 2104 could be configured to buffer input data for processing by the processor 2102. Additionally or alternatively, the memory device 2104 may be configured to store instructions for execution by the processor 2102.

The electronic device 2100 may also include a user interface 2106 that allows a user of the electronic device 2100 to interact with the electronic device 2100. For example, the user interface 2106 can take a variety of forms, such as a button, keypad, dial, touch screen, audio input interface, visual/image capture input interface, input in the form of sensor data, etc. Still further, the user interface 2106 may be configured to output information to the user through a display, speaker, or other output device. A communication interface 2108 may provide for transmitting and receiving data through, for example, a wired or wireless network such as a local area network (LAN), a metropolitan area network (MAN), and/or a wide area network (WAN), for example, the Internet.

The electronic device 2100 may also include a solid state deposition module 2110. The processor 2102 may be embodied as, include or otherwise control the solid state deposition module 2110. The solid state deposition module 2110 may be configured for controlling or executing solid state deposition operations as discussed herein including, for example, deposition of cosmetic layers of material and attachment and creation of structures from a solid state deposition.

FIGS. 32-36 illustrate cosmetic blending where material is removed forming a recess with feathered edges. In particular, material is removed and the surrounding area is filled with deposited material. Subsequently, deposited material is removed revealing a feathered interface between substrate and deposited region. In some embodiments, the blending techniques described in FIGS. 32-36 may be incorporated in previous embodiments (e.g., FIGS. 20-29).

Figure 32:
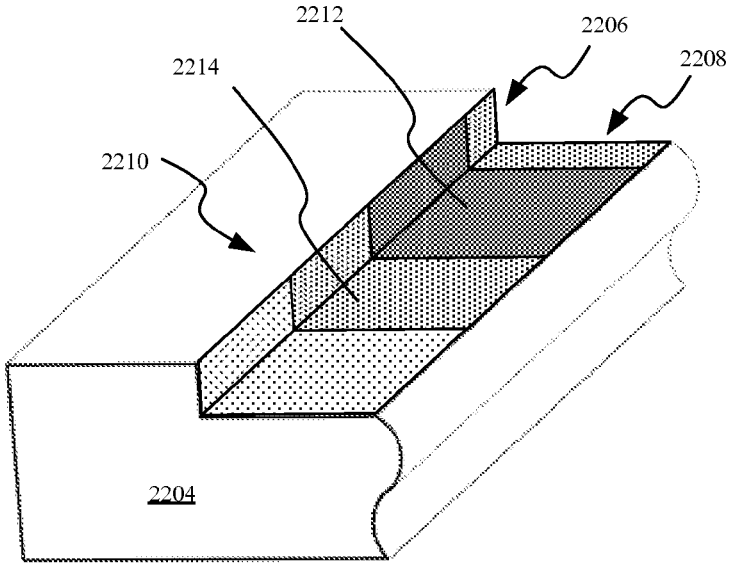
FIGS. 32-36 illustrate cosmetic blending by forming a recess having feathered edges.

It should be noted that when cosmetic blending is desired, a recess is created at the area where the blending is desired as shown in FIG. 32. In FIG. 32, substrate 2204 includes a removal process to remove a portion of substrate 2204 to define first surface 2206 and second surface 2208 in substrate, first surface 2206 and second surface 2208 defining a recess. A blending process forming first deposition 2210 across first surface 2206 and second surface 2208 is incorporated such that first surface 2206 and second surface 2208 include an appearance that is consistent across first surface 2206 and second surface 2208, despite underlying layers of first surface 2206 and second surface 2208 having different appearances. The blending process may include any techniques previously described, including but not limited to, dispersing particles having different densities, different colors, and/or different kinetic energies. In addition, the particles may be dispersed through different nozzles and further dispersed at different distances from first surface 2206 and second surface 2208. In this manner, first surface 2206 and second surface 2208 may include first deposition 2210 having particles forming a surface, the particle having, for example, different color, different material makeup, or different surface texture, or a combination thereof, as compared to second deposition 2212 and or third deposition 2214. The blending process may include several portions having several different material properties in order to create a consistent appearance across the surfaces. In other words, areas corresponding to first deposition 2210 and second deposition 2212 may appear substantially similar, or in some cases identical.

Figure 33:
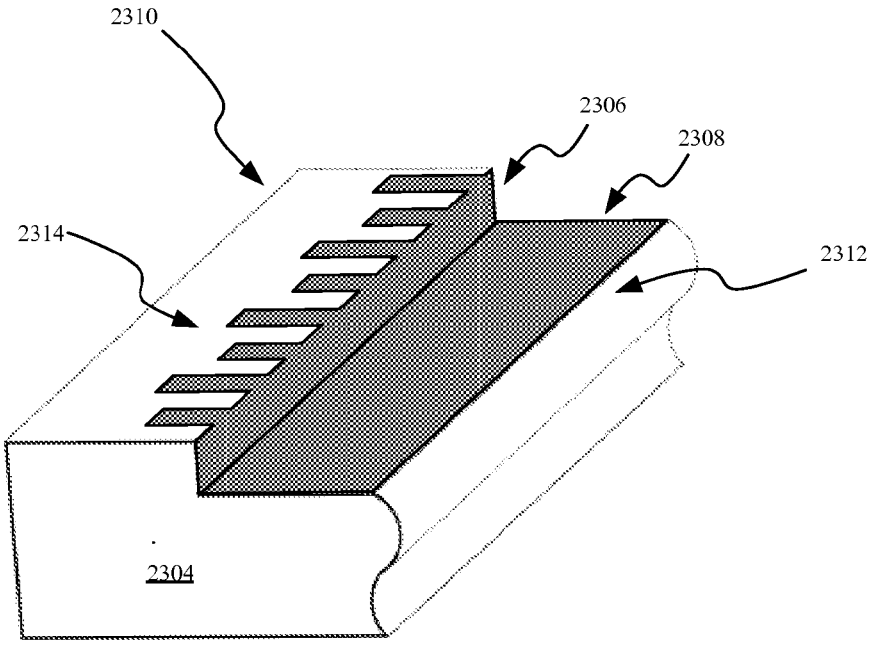

FIG. 33 illustrates a feather process of substrate 2304. Substrate 2304 includes first surface 2306, second surface 2308, and third surface 2310. While first surface 2306 and second surface 2308 are covered with a solid state deposition 2312, third surface 2310 includes a feather portion 2314 of the solid state deposition 2312. In some embodiments, the feathering occurs during the creation of the removed portion of substrate 2304 that defines first surface 2206, second surface 2208, and third surface 2310. In other embodiments, the feathering process is performed as a secondary operation. Also, feathering of edges can be continuous or discontinuous recessed area. For example as shown in FIG. 33, feathered portion 2314 is performed continuously near an edge of first surface 2306 having extensions with differing dimensions (e.g., lengths).

Figure 34:
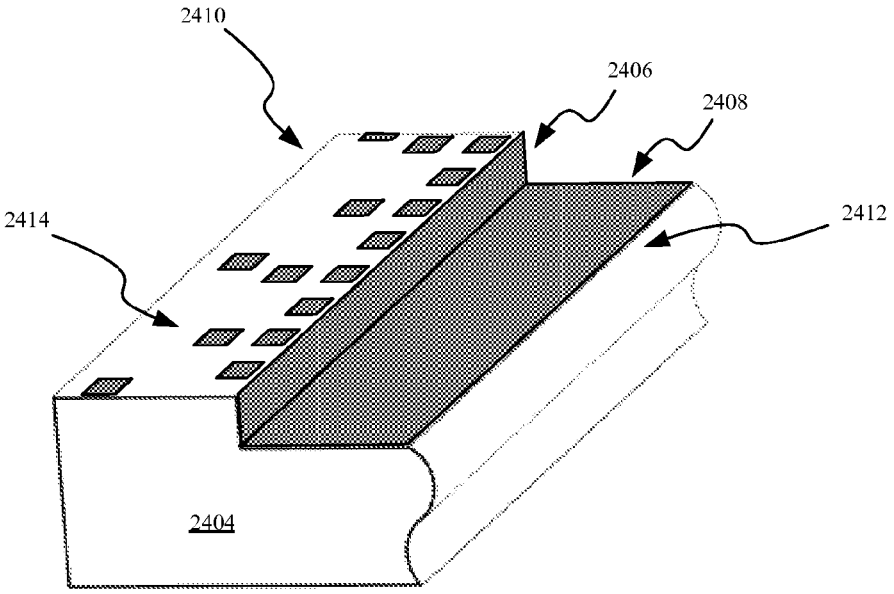

Alternatively, recesses can be discontinuous and scattered to create a feathering of removed materials as shown in FIG. 34. In FIG. 34, substrate 2404 includes first surface 2206, second surface 2208, and third surface 2310. While first surface 2406 and second surface 2408 include a solid state deposition 2412, third surface 2410 with includes a discontinuous solid state deposition 2414.

Figure 35:
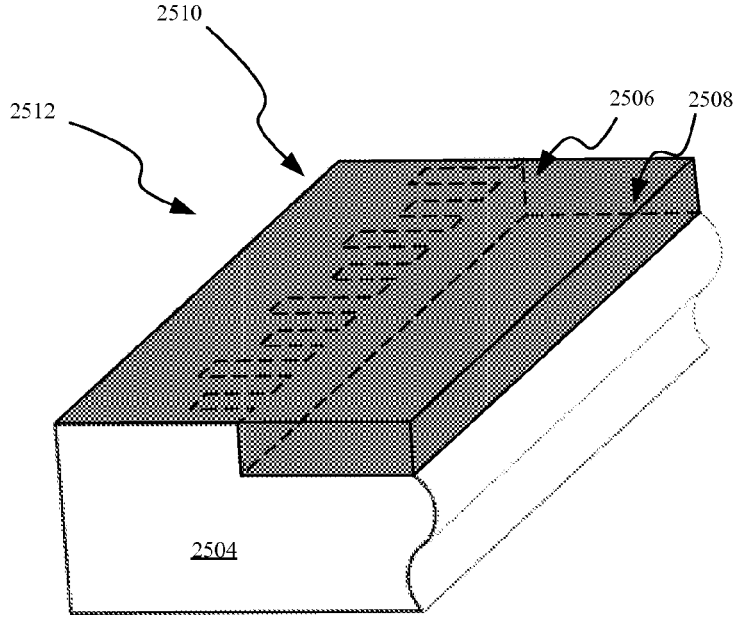
Figure 36:
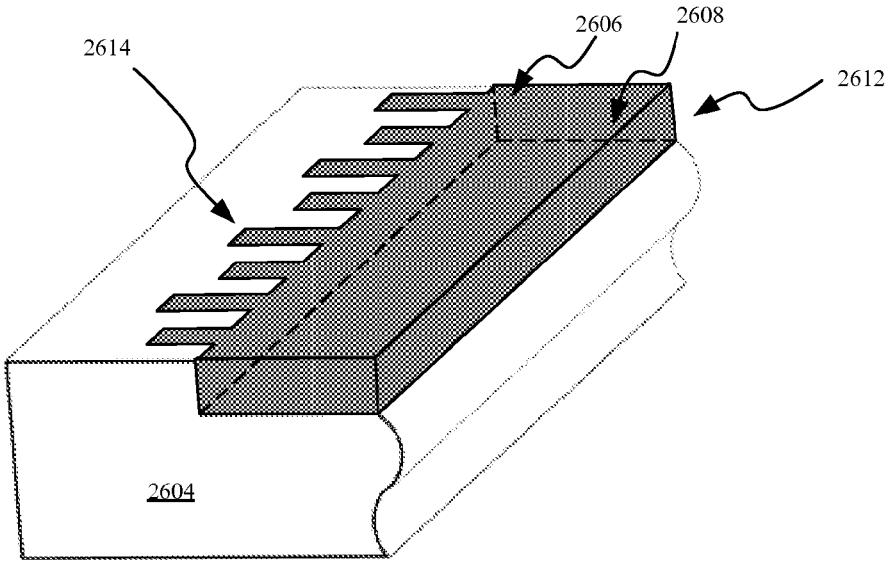

As shown in FIG. 35, substrate 2504 includes a solid state deposition 2512 deposited to fill all removed material (e.g., defining first surface 2506 and second surface 2508) and cover the surrounding area, including third surface 2510. This illustrates a deposition of materials (e.g., solid state deposition 2512) may include a substantial thickness. FIG. 36 further illustrates this, as substrate 2604 includes a solid state deposition 2612 filling in a recessed area (e.g., area removed to define first surface 2606 and second surface 2608), with the solid state deposition 2612 further including a feathered portion 2614.

Figure 37:
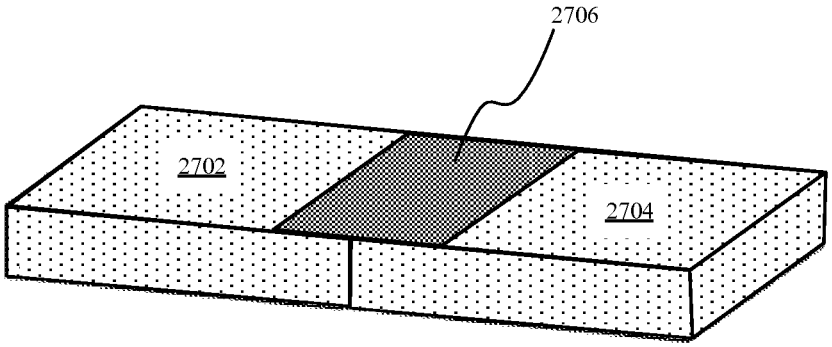
FIG. 37 illustrates two substrates joined by a solid state deposition layer having an appearance different from the two substrates, in accordance with the described embodiments.

While some embodiments include a solid state deposition having an appearance substantially similar to that of the parts or substrates, in other embodiments, the solid state deposition layer may have an appearance different from that of the parts. For example, FIG. 37 illustrates first substrate 2702 and second substrate 2704, both of which are joined together by solid state deposition 2706. In some embodiments, first substrate 2702 and second substrate 2704 are joined together to form a portion of an enclosure of an electronic device. Generally, first substrate 2702 and second substrate 2704 have a similar appearance in terms of color, roughness, and/or reflectivity. However, solid state deposition 2706 includes a different appearance than that of first substrate 2702 and second substrate 2704. In some embodiments, solid state deposition 2706 is formed from different materials than that of first substrate 2702 and second substrate 2704. For example, in some embodiments, solid state deposition 2706 is formed from nickel or magnesium, while first substrate 2702 and second substrate 2704 are formed from aluminum or steel. In other embodiments, solid state deposition 2706 is formed from a similar material to that of first substrate 2702 and second substrate 2704, yet solid state deposition 2706 is applied with a low average kinetic energy such that solid state deposition 2706 includes a roughness greater than that of first substrate 2702 and second substrate 2704. This may cause solid state deposition 2706 to have a different reflectivity than that of first substrate 2702 and second substrate 2704. Also, in some embodiments, solid state deposition 2706 is formed from steel particles, which may further provide an improved cosmetic appearance after polishing, as compared to other particles.

Also, solid state deposition 2706 may further enhance the appearance of the joined substrates (first substrate 2702 and second substrate 2704) by providing a unique design or finish. In some embodiments, solid state deposition 2706 is applied to form, for example, a logo or trademark, or any indicia configured to enhance the appearance of the joined substrates. In some embodiments, solid state deposition 2706 is deposited entirely over a two-dimensional surface of both first substrate 2702 and second substrate 2704 such that a surface of first substrate 2702 and second substrate 2704 have an appearance of continuity due to solid state deposition 2706 covering the two-dimensional surfaces.

Figure 38:
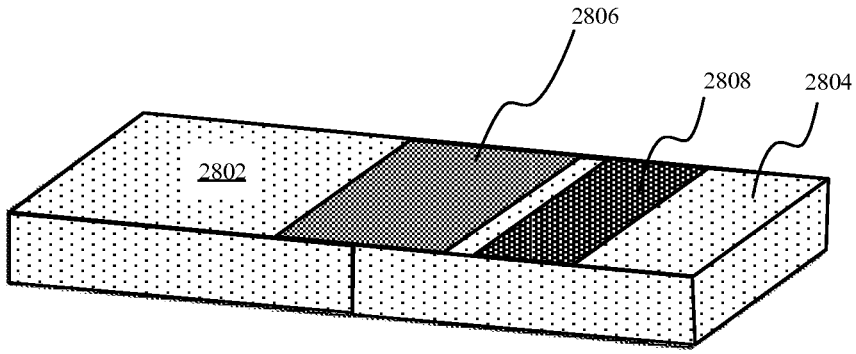
FIG. 38 illustrates substrates joined by a first solid state deposition layer having an appearance different from the two substrates, as well a second solid state deposition layer having an appearance different from the first substrate, the second substrate, and the first solid state deposition.

In addition to using a solid state deposition to join substrates having a different appearance than that of the solid state deposition, a second solid state deposition may be applied to further enhance the appearance of the joined substrates. FIG. 38 illustrates first substrate 2802 and second substrate 2804 (both of which may form a portion of an enclosure of an electronic device) joined together by first solid state deposition 2806, with first solid state deposition 2806 having an appearance different from that of first substrate 2802 and second substrate 2804. The difference in appearance may be any difference previously described. Also, second solid state deposition 2808 is applied to second substrate 2804. In other embodiments, second solid state deposition 2808 is applied to first substrate 2802. Second solid state deposition 2808 is not only different in appearance from first solid state deposition 2806, but is also different in appearance from first substrate 2802 and second substrate 2804. In this manner, second solid state deposition 2808 is used to further enhance the overall appearance of the joined substrates (first substrate 2802 and second substrate 2804). Also, in some embodiments, second solid state deposition 2808 is applied to form, for example, a logo or trademark, or any indicia configured to enhance the appearance of the joined substrates. Also, first solid state deposition 2806 and second solid state deposition 2808 may be formed from a material selected from metallic particles such as aluminum particles, nickel particles, steel particles, magnesium particles, or a combination thereof, such that both first solid state deposition 2806 and second solid state deposition 2808 are different from first substrate 2802 and second substrate 2804, and first solid state deposition 2806 is different from second solid state deposition 2808.

Also, while first solid state deposition 2806 and second solid state deposition 2808 are shown in FIG. 38, in other embodiments, at least three solid state depositions may be applied to first substrate 2802 or second substrate 2804 in order to further enhance the cosmetic appearance of the joined substrates.

The various aspects, embodiments, implementations or features of the described embodiments can be used separately or in any combination. Various aspects of the described embodiments can be implemented by software, hardware or a combination of hardware and software.

The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments.

Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A substrate for enclosing an electronic device, comprising:

a first substrate in co-planar arrangement with a second substrate along a joint line;

a deposition layer including metallic particles that cover at least the joint line; and a pre-formed mechanical structure that is joined to portions of the first and second substrates, wherein the first and second substrates are joined together by the deposition layer and the pre-formed mechanical structure.

2. The substrate as recited in claim 1, wherein the first and second substrates are joined together at their respective mating surfaces that correspond to the joint line, and the pre-formed mechanical structure extends through the mating surfaces.

3. The substrate as recited in claim 1, wherein the pre-formed mechanical structure includes a first fastener and a second fastener, and the first fastener is positioned over the second fastener.

4. The substrate as recited in claim 1, wherein the first substrate includes a groove defining the pre-formed mechanical structure, and the second substrate includes a tapered end positioned within the groove and having a shape corresponding to the pre-formed mechanical structure.

5. The substrate as recited in claim 4, wherein the deposition layer is positioned within a region between the tapered end and the groove.

6. The substrate as recited in claim 1, wherein at least one of the first or second substrates includes a channel that is covered by the deposition layer.

7. The substrate as recited in claim 1, wherein the deposition layer has an external surface having a texture that is generally similar to textures of external surfaces of the first and second substrates.

8. The substrate as recited in claim 1, further comprising a second deposition layer that is disposed over the deposition layer, the second deposition layer having different metallic particles than the deposition layer.

9. The substrate as recited in claim 8, wherein the second deposition layer is blended with the deposition layer, the first substrate, and the second substrate to provide an appearance of continuity among the first substrate, the second substrate, the deposition layer, and the second deposition layer.

10. A method for joining a first substrate with a second substrate, the method comprising:

aligning the first substrate to the second substrate along a joint line;

inserting a mechanical structure through portions of the first substrate and the second substrate; and covering at least the joint line with a solid state deposition layer, wherein the first substrate and the second substrate are held together by the solid state deposition layer and the mechanical structure.

11. The method as recited in claim 10, further comprising depositing a second solid state deposition layer proximate to the solid state deposition layer, wherein the second solid state deposition layer is formed from a material different than the solid state deposition layer.

12. The method as recited in claim 10, wherein the solid state deposition layer covers portions of external surfaces of the first and second substrates.

13. The method as recited in claim 10, wherein:

the mechanical structure includes a first fastener and a second fastener, and the first fastener is a pin or a screw, and the second fastener is a clamp mechanism.

14. The method as recited in claim 10, wherein at least one of the first or second substrates includes an external channel, and the external channel is covered by the solid state deposition layer.

15. The method as recited in claim 10, further comprising:

positioning a part on the first substrate, depositing the solid state deposition layer over the part; and subsequent to depositing the solid state deposition layer over the part, removing the part to define a space previously occupied by the part.

16. The method as recited in claim 10, wherein the solid state deposition layer has an external surface having a texture that is generally similar to textures of external surfaces of the first and second substrates.

17. An enclosure for an electronic device, comprising:

a joined part, comprising:

a first part that is joined to a second part along an interface, a solid state deposition layer that covers portions of the first part and the second part, and a mechanical structure that is inserted through the portions of the first part and the second part, wherein the first part and the second part are joined together by the solid state deposition layer and the mechanical structure.

18. The enclosure of claim 17, wherein the mechanical structure includes at least one of a weld, a pin, a clamp, or a screw.

19. The enclosure of claim 17, wherein at least one of the first or the second part includes a channel, and the solid state deposition layer is disposed over the channel.

20. The enclosure of claim 19, wherein the channel is defined by walls that extend away from an external portion of the first or the second part.

21. The enclosure of claim 17, wherein the solid state deposition layer has an external surface with a texture that is generally similar to textures of external surfaces of the first and second substrates.

* * * * *